US012017875B2

(12) United States Patent
Tezuka et al.

(10) Patent No.: US 12,017,875 B2
(45) Date of Patent: Jun. 25, 2024

(54) MEDIUM-TRANSPORTING DEVICE AND IMAGE READING APPARATUS

(71) Applicant: SEIKO EPSON CORPORATION, Tokyo (JP)

(72) Inventors: Seiji Tezuka, Kitakyushu (JP); Koji Migita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 178 days.

(21) Appl. No.: 17/809,016

(22) Filed: Jun. 27, 2022

(65) Prior Publication Data

US 2022/0411215 A1 Dec. 29, 2022

(30) Foreign Application Priority Data

Jun. 28, 2021 (JP) ..... 2021-106717

(51) Int. Cl.

| | |
|---|---|
| ***B65H 5/06*** | (2006.01) |
| ***B65H 5/36*** | (2006.01) |
| ***B65H 5/38*** | (2006.01) |
| ***B65H 15/00*** | (2006.01) |
| ***G03G 15/00*** | (2006.01) |

(52) U.S. Cl.

CPC ..... *B65H 15/004* (2020.08); *B65H 5/062* (2013.01); *B65H 2301/333* (2013.01); *B65H 2301/3423* (2013.01)

(58) Field of Classification Search

CPC ..... B65H 2601/11; B65H 2601/321; B65H 5/062; B65H 5/36; B65H 5/38; B65H 2402/441; B65H 2404/1442; B65H 2404/6111; B65H 2404/1521; B65H 15/004; G03G 21/1638; H04N 1/00543

See application file for complete search history.

(56) References Cited

U.S. PATENT DOCUMENTS

| | | | | |
|---|---|---|---|---|
| 7,637,501 | B2 * | 12/2009 | Akiyama | B65H 5/38 399/125 |
| 8,074,983 | B1 * | 12/2011 | Hsu | B65H 5/062 271/264 |
| 2007/0045945 | A1 * | 3/2007 | Iwago | H04N 1/00588 271/272 |
| 2007/0132173 | A1 * | 6/2007 | Lin | H04N 1/00602 271/121 |
| 2012/0170087 | A1 * | 7/2012 | Nose | H04N 1/00543 358/498 |

FOREIGN PATENT DOCUMENTS

JP 2004-175534 A 6/2004

* cited by examiner

*Primary Examiner* — Luis A Gonzalez
(74) *Attorney, Agent, or Firm* — WORKMAN NYDEGGER

(57) ABSTRACT

A document transporting device includes a main body unit that forms an inner side of an inverting path, a cover unit that exposes a portion of the inverting path, a movable unit, a transport roller, a driven roller, and a roller supporting unit that forms an outer side of the inverting path. By receiving a force from the cover unit, the roller supporting unit rotates in a direction in which the driven roller moves away from the transport roller. By receiving a force from the roller supporting unit, the movable unit rotates in a direction in which the movable unit retreats from the main body unit.

12 Claims, 14 Drawing Sheets

MEDIUM-TRANSPORTING DEVICE AND IMAGE READING APPARATUS

The present application is based on, and claims priority from JP Application Serial Number 2021-106717, filed Jun. 28, 2021, the disclosure of which is hereby incorporated by reference herein in its entirety.

BACKGROUND

1. Technical Field

The present disclosure relates to a medium-transporting device and an image reading apparatus.

2. Related Art

A document feeding device according to JP-A-2004-175534 includes a feeding roller and a driven roller that form a nip portion, a roller attachment member that has the driven roller and swings freely, a document cover that rotates freely, and a fixing guide that guides a document to an image reading unit. When the document cover is opened, a portion of the document cover comes into contact with the roller attachment member, and the roller attachment member thereby rotates. As a result, the roller attachment member moves away from the feeding roller.

According to a configuration in which a fixing guide is provided around a portion in which a medium is nipped on an inverting path on which the medium is inverted, as in the configuration of JP-A-2004-175534, even when nipping is terminated in a so-called jam state in which the medium jams on the inverting path, the inverting path in the fixing guide does not change in size. Accordingly, it may be difficult for the medium to be removed from the inverting path in the state in which the medium has jammed.

SUMMARY

To address the aforementioned problem, a medium-transporting device according to the disclosure includes: a first unit that forms an inner side of an inverting path on which a medium is inverted while being curved; a second unit that forms an outer side of the inverting path and retreats from the first unit to expose a portion of the inverting path in a transport direction of the medium; a third unit that forms the outer side of the inverting path in a portion downstream of the second unit in the transport direction and is provided so as to be rotatable about a first rotational shaft such that the third unit is configured to be reciprocated with respect to the first unit; an inner roller that is rotatably provided in the first unit and transports the medium to a portion downstream in the transport direction; at least one outer roller located outside the inverting path and configured to transport the medium by rotating with the inner roller; and at least one supporting unit that supports the outer roller so as to be rotatable, that is provided so as to be rotatable about a second rotational shaft, and that forms the outer side of the inverting path, in which the second unit is configured to apply a pressing force to the supporting unit in accordance with an exposing operation, the supporting unit is configured to rotate, by receiving a force from the second unit, in a direction in which the outer roller moves away from the inner roller, and the third unit is configured to rotate, by receiving a force from the supporting unit, in a direction in which the third unit retreats from the first unit.

DESCRIPTION OF EXEMPLARY EMBODIMENTS

Figure 1:
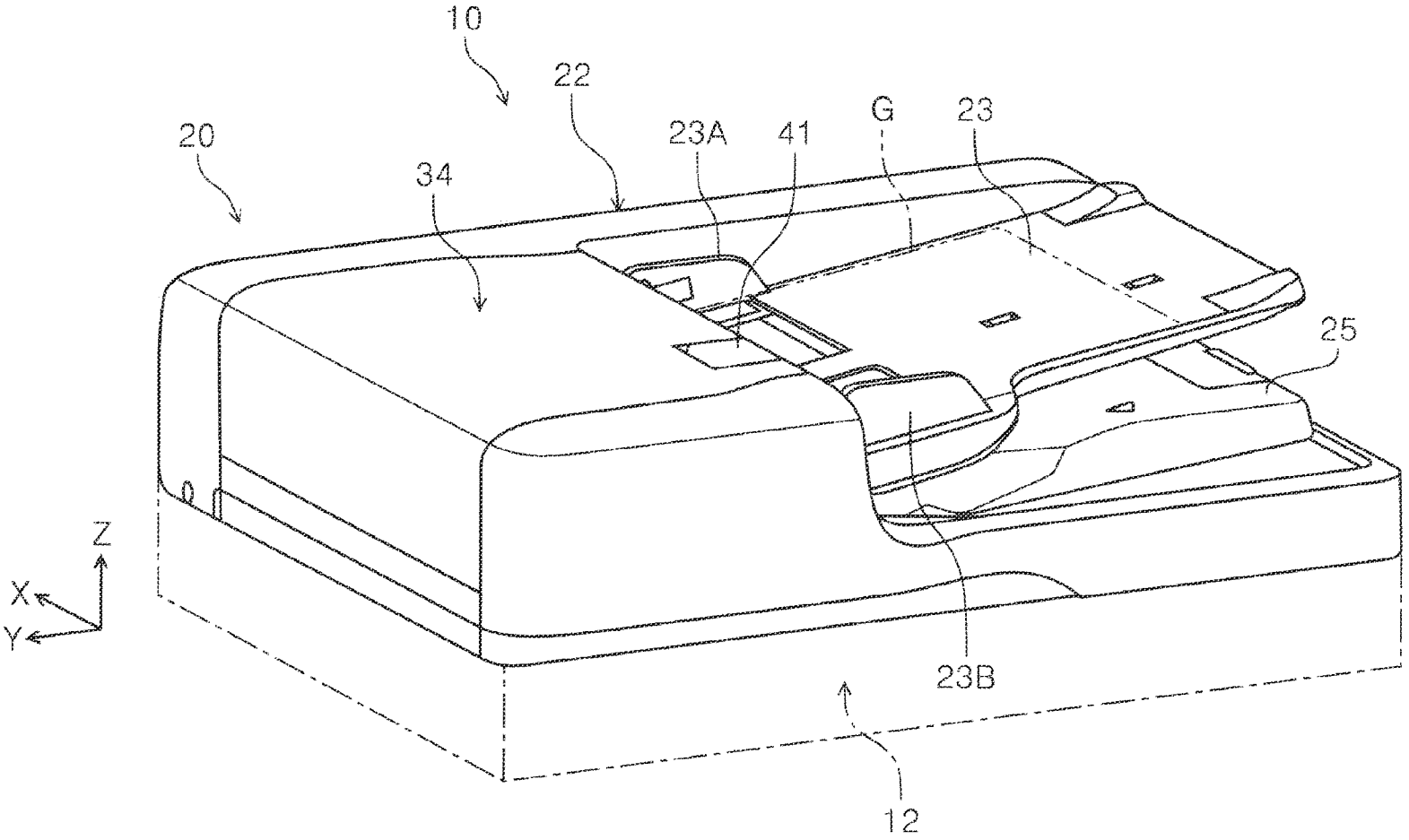
FIG. 1 is a perspective view of a scanner in a state in which both of a document transporting device and a cover unit are closed.

Hereinafter, the disclosure will be schematically described.

A medium-transporting device according to a first aspect includes: a first unit that forms an inner side of an inverting path on which a medium is inverted while being curved; a second unit that forms an outer side of the inverting path and retreats from the first unit to expose a portion of the inverting path in a transport direction of the medium; a third unit that forms the outer side of the inverting path in a portion downstream of the second unit in the transport direction and is provided so as to be rotatable about a first rotational shaft such that the third unit is configured to be reciprocated with respect to the first unit; an inner roller that is rotatably provided in the first unit and transports the medium to a portion downstream in the transport direction; at least one outer roller located outside the inverting path and configured to transport the medium by rotating with the inner roller; and at least one supporting unit that supports the outer roller so as to be rotatable, that is provided so as to be rotatable about a second rotational shaft, and that forms the outer side of the inverting path, in which the second unit is configured to apply a pressing force to the supporting unit in accordance with an exposing operation, the supporting unit is configured to rotate, by receiving a force from the second unit, in a direction in which the outer roller moves away from the inner roller, and the third unit is configured to rotate, by receiving a force from the supporting unit, in a direction in which the third unit retreats from the first unit.

According to the present aspect, when a so-called jam state in which the deformed medium jams on the inverting path occurs, the second unit retreats from the first unit, and a portion of the inverting path is thereby exposed. At this time, the second unit applies the pressing force to the supporting unit in accordance with the exposing operation.

By receiving the force from the second unit, the supporting unit rotates about the second rotational shaft. The outer roller thereby moves away from the inner roller.

By receiving the force from the supporting unit, the third unit rotates about the first rotational shaft. The third unit thereby retreats from the first unit.

As described above, in accordance with the exposing operation of the second unit, the supporting unit rotates, and, furthermore, the third unit rotates relative to the supporting unit. Accordingly, it is possible to easily remove the medium in the jam state from the inverting path compared with a configuration in which at least one of the supporting unit and the third unit is fixed.

In the medium-transporting device according to a second aspect, the supporting unit in the first aspect includes a first extension section that extends in one direction from the second rotational shaft and supports the outer roller and a second extension section that extends in another direction from the second rotational shaft and is configured to come into contact with the second unit, and in a state in which the second extension section receives a pressing force from the second unit, the second extension section is moved to the inner roller, and the first extension section is moved in a direction away from the inner roller.

According to the present aspect, since the first extension section is located on one side with respect to the second rotational shaft and the second extension section is located on the other side with respect to the second rotational shaft, a direction in which the second extension section receives the pressing force from the second unit is able to be set to be opposite to a direction in which the first extension section and the outer roller move away from the inner roller.

In the medium-transporting device according to a third aspect, the supporting unit in the second aspect includes an elastic member held by the first extension section and the third unit, and in a closed state in which the second unit forms the outer side of the inverting path, the elastic member applies an elastic force to the supporting unit such that the outer roller approaches the inner roller.

According to the present aspect, in the closed state, since the elastic member applies the elastic force to the supporting unit, the outer roller approaches the inner roller. As a result, a nip pressure applied to the medium is secured in a nip portion formed by the outer roller and the inner roller, thus making it possible to suppress a transport failure of the medium in the nip portion from occurring.

In the medium-transporting device according to a fourth aspect, a plurality of supporting units are provided in an intersecting direction intersecting the transport direction, in any one of the first to third aspects.

According to the present aspect, when a single outer roller is provided, since the outer roller is supported at multiple positions in the intersecting direction, it is possible to suppress the outer roller from being warped. When a plurality of outer rollers are provided, since a gap between supporting points in the intersecting direction, at which the outer rollers are supported by the supporting units, is small compared with an instance in which a single supporting unit is provided, it is possible to suppress the outer roller from being warped.

In the medium-transporting device according to a fifth aspect, a sheet member is provided in a portion of a path surface of the third unit, which forms the inverting path, in the fourth aspect, and the sheet member extends to a portion downstream of the third unit in the transport direction from a portion located between the supporting units, which are adjacent to each other.

According to the present aspect, when passing through a portion of the third unit which forms the inverting path, a downstream end of the transported medium in the transport direction is guided by the sheet member. It is thus possible to stabilize the orientation of the medium transported from the third unit to a portion downstream in the transport direction.

In the medium-transporting device according to a sixth aspect, the plurality of supporting units in the fourth or fifth aspect include a first supporting unit that includes a first contact section and is located on a center side in the intersecting direction and a second supporting unit that includes a second contact section and is located outside the first supporting unit in the intersecting direction, the second unit includes a first contacting surface configured to come into contact with the first contact section and a second contacting surface configured to come into contact with the second contact section, and the first contacting surface is located downstream of the second contacting surface in a movement direction in which the second unit approaches the first supporting unit and the second supporting unit.

According to the present aspect, even when the first supporting unit is located downstream of the second supporting unit in the movement direction, for example, due to warping of a member that supports the first supporting unit or the second supporting unit, since the first contacting surface is located downstream of the second contacting surface, a time point when the first contacting surface comes into contact with the first contact section is able to coincide with a time point when the second contacting surface comes into contact with the second contact section.

In the medium-transporting device according to a seventh aspect, when the medium is transported on the inverting path, an upstream end of the supporting unit in the transport direction is located farther than the path surface of the third unit, which forms the inverting path, from the first unit, in any one of the first to sixth aspects.

According to the present aspect, since the upstream end of the supporting unit in the transport direction is located farther than the path surface from the first unit, when the medium is transported on the inverting path, a downstream end of the medium in the transport direction is able to be suppressed from being caught by the supporting unit compared with a configuration in which the upstream end is located closer than the path surface to the first unit.

In the medium-transporting device according to an eighth aspect, when the medium is transported on the inverting path, a downstream end of the supporting unit in the transport direction is located closer than the path surface of the third unit, which forms the inverting path, to the first unit, in any one of the first to seventh aspects.

According to the present aspect, since the downstream end of the supporting unit in the transport direction is located closer than the path surface to the first unit, when the medium is transported on the inverting path, an upstream end of the medium in the transport direction is readily supported at a high position compared with a configuration in which the downstream end is located farther than the path surface from the first unit. As a result, it is possible to suppress the upstream end of the medium in the transport direction of the medium from vibrating or rebounding when separating from the path surface.

The medium-transporting device according to a ninth aspect further includes a frame member that rotatably supports the first rotational shaft and a third rotational shaft, in which the second unit in any one of the first to eighth aspects is provided so as to be rotatable about the third rotational shaft.

According to the present aspect, since the first rotational shaft and the third rotational shaft are supported by the common frame member, accuracy in relative positions of the first rotational shaft and the third rotational shaft is enhanced compared with a configuration in which the first rotational shaft and the third rotational shaft are supported by different members. As a result, accuracy in relative positions of the supporting unit, which is supported by the third unit, and the second unit is also enhanced, and it is thus possible to suppress a deviation in the position at which the second unit and the supporting unit come into contact with each other from occurring.

In the medium-transporting device according to a tenth aspect, the supporting unit in any one of the first to ninth aspects includes a restricting section that restricts a rotational amount of the supporting unit when the supporting unit rotates in the direction in which the outer roller moves away from the inner roller.

According to the present aspect, the restricting section restricts the rotational amount of the supporting units, and some of the supporting units are thus restricted from excessively approaching the first unit. As a result, it is possible to suppress a portion of the inverting path from being reduced more than necessary in accordance with rotation of the supporting unit.

In the medium-transporting device according to an eleventh aspect, an opening/closing unit that includes the first unit, the second unit, the third unit, and the supporting unit is coupled to a base unit, which supports the opening/closing unit, so as to be openable/closable, and when a state in which the opening/closing unit closes the base unit and in which the second unit forms the inverting path is a first setting state, a state in which the opening/closing unit closes the base unit and in which the second unit exposes the inverting path is a second setting state, and a state in which the opening/closing unit opens the base unit and in which the second unit exposes the inverting path is a third setting state and when a space of the inverting path formed by the first unit and the third unit in the first setting state is a first space, a space of the inverting path formed by the first unit and the third unit in the second setting state is a second space, and a space of the inverting path formed by the first unit and the third unit in the third setting state is a third space, the second space is wider than the first space, and the third space is wider than the second space, in any one of the first to tenth aspects.

According to the present aspect, in the second setting state, the second space is wider than the first space, and the medium is thus easily removed from the inverting path. In the third setting state, the third space is wider than the second space, and the medium is thus more easily removed from the inverting path.

An image reading apparatus according to a twelfth aspect includes: a reading section that reads a surface of a medium that is transported; and the medium-transporting device according to any one of the first to eleventh aspects that transports the medium to the reading section.

According to the present aspect, a portion of the medium is suppressed from remaining on the inverting path when the medium in a jam state is removed from the inverting path. Accordingly, it is possible to suppress a reading failure from occurring when the reading section performs the next reading operation.

A scanner 10 and a document transporting device 20 according to an example of an embodiment of the disclosure will be specifically described below.

As illustrated in FIG. 1, the scanner 10 is an apparatus for reading a document G, which is an example of a medium. The X-Y-Z coordinate system illustrated in each drawing is an orthogonal coordinate system.

The X direction is an example of a width direction of the document G and an apparatus depth direction and is also an example of an intersecting direction intersecting a transport direction of the document G. In the present embodiment, the −X direction corresponds to the apparatus front side, and the +X direction corresponds to the apparatus rear side.

The Y direction is an example of an apparatus width direction, and, from the view of the user, the +Y direction corresponds to the left side, and the −Y direction corresponds to the right side.

The Z direction is an example of an apparatus height direction and an example of the vertical direction. The +Z direction corresponds to the upper side, and the −Z direction corresponds to the lower side.

In a state in which the scanner 10 is viewed in the +X direction from the apparatus front side, the clockwise direction is direction +R, and the counterclockwise direction is direction −R.

Figure 2:
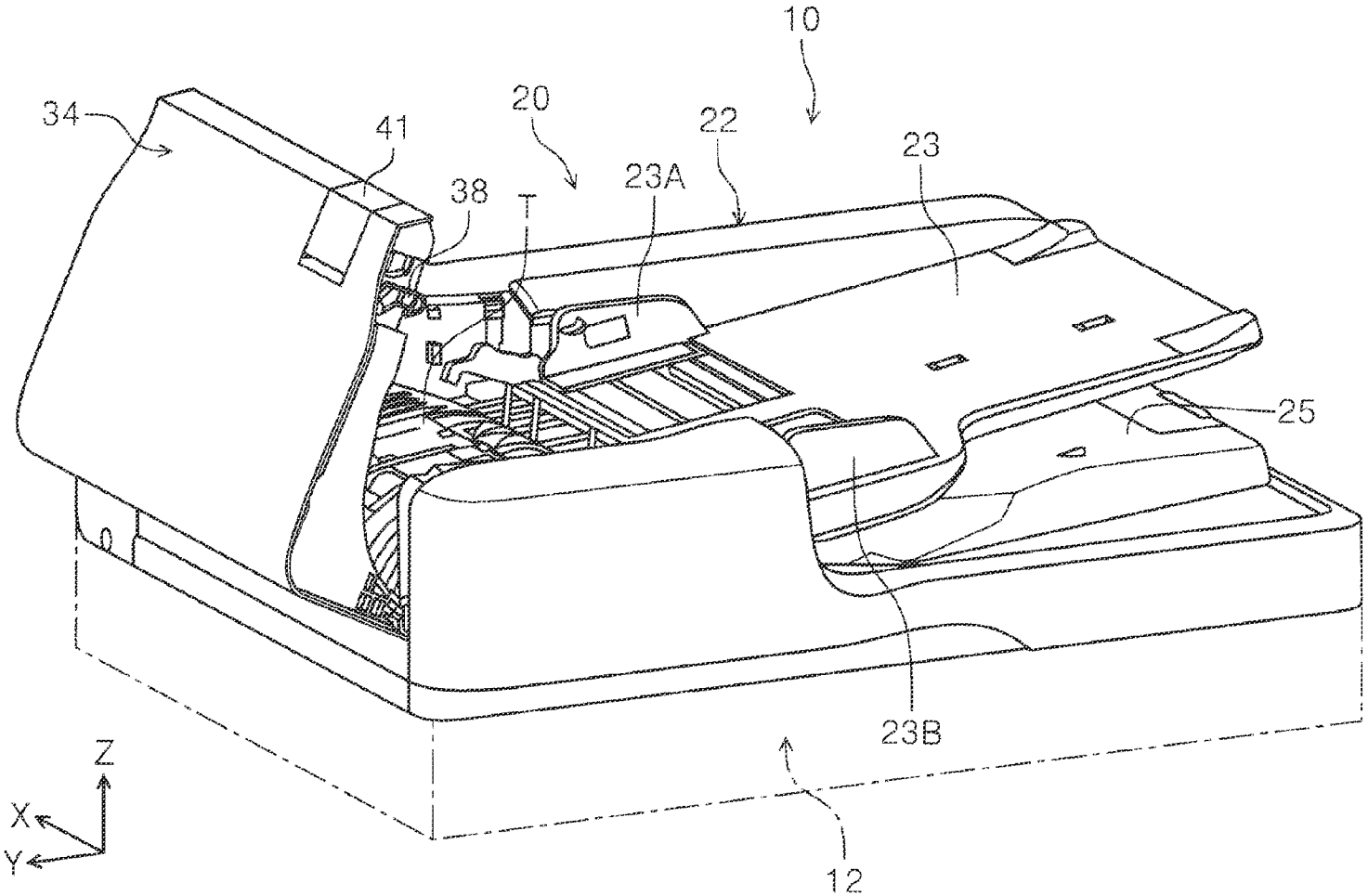
FIG. 2 is a perspective view of the scanner in a state in which the document transporting device is closed and in which the cover unit is open.

FIGS. 1 and 2 illustrate the scanner 10.

The scanner 10 is an example of an image reading apparatus for reading the document G. The scanner 10 includes an apparatus lower portion 12, which forms a lower portion of the scanner 10 in the Z direction, and the document transporting device 20, which forms an upper portion of the scanner 10 in the Z direction and transports the document G.

The apparatus lower portion 12 is an example of a base unit and supports the document transporting device 20.

Figure 4:
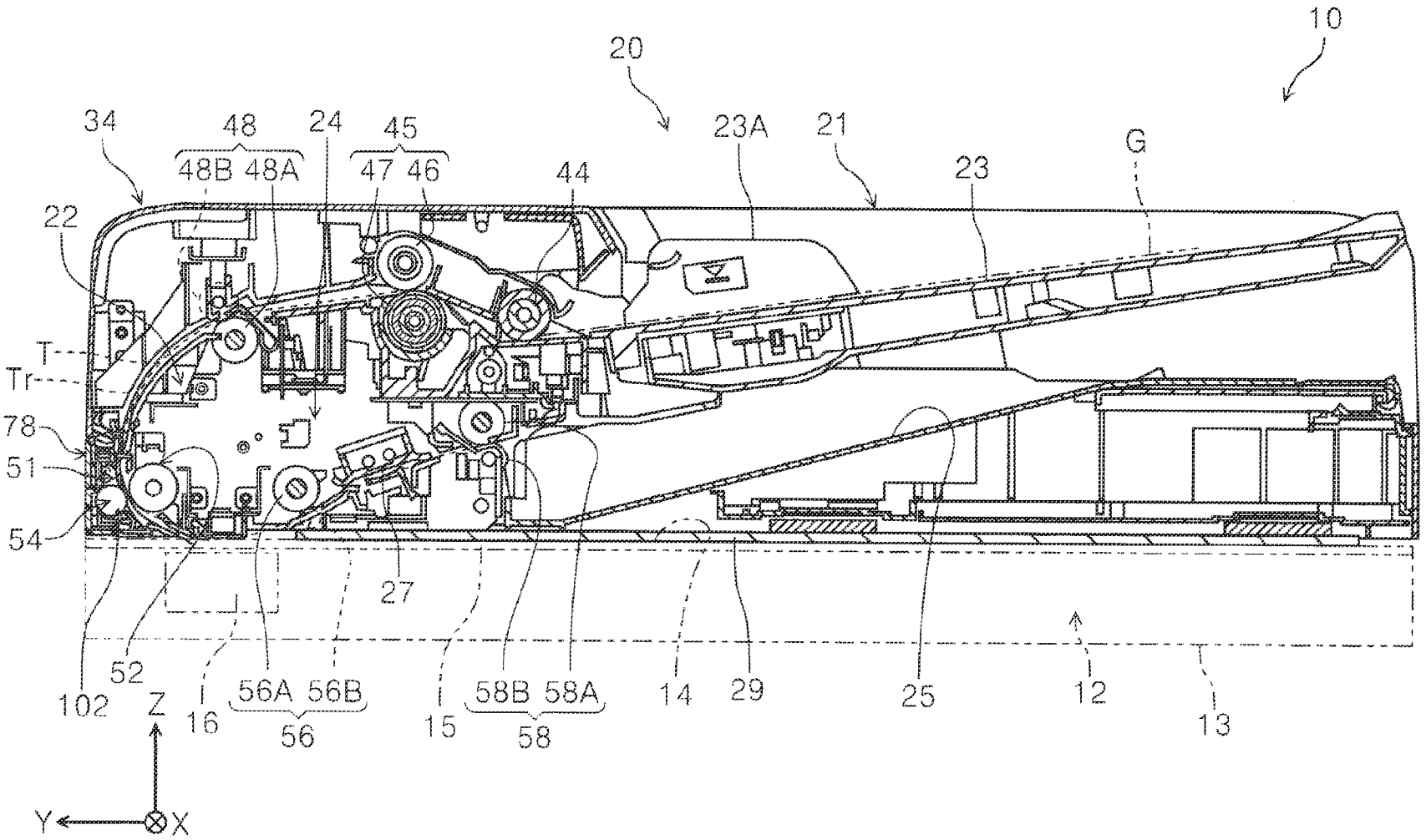
FIG. 4 illustrates an inverting path for a document in the state in which both of the document transporting device and the cover unit are closed.

As illustrated in FIG. 4, in the document transporting device 20 described later, the document G is transported on an inverting path T. A direction in which the document G is transported is the transport direction of the document G. Note that the inverting path T includes not only a linear portion but also a semicircular portion described later. Accordingly, the transport direction of the document G is not a constant direction.

The inverting path T is a path which extends from a separation roller pair 45 described later to a discharge roller pair 58 described later and on which the document G is transported. When viewed in the X direction, the inverting path T includes the semicircular portion that protrudes in the +Y direction. On the inverting path T, the front side and the rear side of the document G are inverted while the document G is curved. In the following description, the semicircular portion of the inverting path T is referred to as an arc portion Tr.

The apparatus lower portion 12 includes a frame (not illustrated) serving as a chassis, a main body cover 13, a document platen glass 15, and a first reading section 16.

The main body cover 13 has a frame shape. The +Z direction end surface of the main body cover 13 is an upper surface 14.

The document platen glass 15 is provided inside the main body cover 13.

The first reading section 16 is provided in the −Z direction with respect to the document platen glass 15 so as to be movable in the Y direction. For example, an optical sensor of a CIS type, a CCD type, or the like is used for the first reading section 16. The first reading section 16 is an example of a reading section and reads one side of the document G transported on the inverting path T or the document G mounted on the document platen glass 15.

The document transporting device 20 is an example of a medium-transporting device that transports the document G to the first reading section 16 or a second reading section 27 described later. The document transporting device 20 includes, for example, an apparatus main body section 21, a transport roller 52, and a driven roller 54.

The apparatus main body section 21 includes a main body unit 22, a cover unit 34, a movable unit 78, and a roller supporting unit 102.

Figure 3:
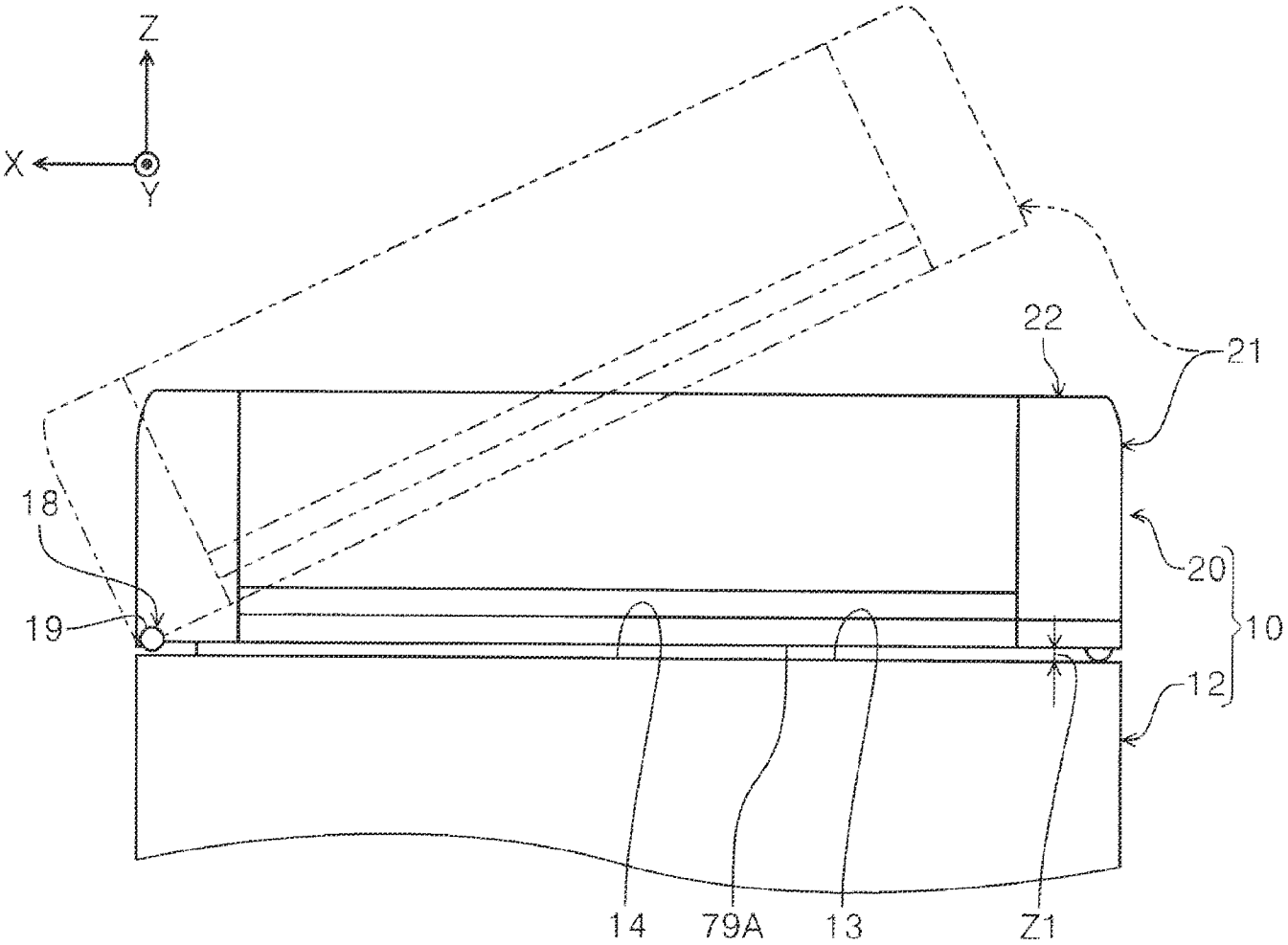
FIG. 3 is a side view schematically illustrating the scanner in a state in which the document transporting device is open.

As illustrated in FIG. 3, the +X direction end in the +Z direction end of the apparatus lower portion 12 and the +X direction end in the −Z direction end of the apparatus main body section 21 are coupled by a hinge section 18. The hinge section 18 has a shaft section 19 that extends in the Y direction.

When the apparatus main body section 21 rotates about the shaft section 19, the document transporting device 20 is opened or closed with respect to the apparatus lower portion 12. In this manner, the apparatus main body section 21 is coupled to the apparatus lower portion 12 so as to be openable/closable.

When the document transporting device 20 is in the open state, the upper surface 14 of the apparatus lower portion 12 is exposed. When the document transporting device 20 is in the closed state, the upper surface 14 is covered by the apparatus main body section 21.

Here, a gap between the document transporting device 20 and the apparatus lower portion 12 in the Z direction is gap Z1. Gap Z1 is specifically a gap between the upper surface 14 and a surface of a bottom wall 79A (FIG. 12) of the movable unit 78 described later, which is furthest in the −Z direction.

In a state in which the +Z direction end of the apparatus lower portion 12 is covered by the document transporting device 20, when gap Z1 is set to be relatively narrow, the movable unit 78 comes into contact with the +Z direction end of the apparatus lower portion 12. Opening of the movable unit 78 is thereby regulated.

On the other hand, in a state in which the +Z direction end of the apparatus lower portion 12 is exposed by the document transporting device 20, a state in which the movable unit 78 is regulated by the apparatus lower portion 12 is terminated, and the movable unit 78 thus becomes openable.

As illustrated in FIG. 4, the main body unit 22 is an example of a first unit. The main body unit 22 forms an inner portion of the arc portion Tr. The main body unit 22 includes a frame member 24. The main body unit 22 includes a document mounting section 23, a document discharge section 25, and the second reading section 27.

The document mounting section 23 has a plate shape. The document mounting section 23 is located in a state of being inclined with respect to the inverting path T. The document G is mounted on the document mounting section 23 before being transported. In the document mounting section 23, an edge guide 23A is provided in the +X direction end, and an edge guide 23B (FIG. 1) is provided in the −X direction end. The edge guides 23A and 23B are provided so as to be slidable in a direction in which the edge guides 23A and 23B approach each other or move away from each other, and the edge guides 23A and 23B align ends of a plurality of documents G on both sides in the X direction.

The document discharge section 25 is located in the −Z direction with respect to the document mounting section 23. The document G that has been transported is mounted on the document discharge section 25.

For example, an optical sensor of a CIS type, a CCD type, or the like is used for the second reading section 27. The second reading section 27 is an example of a reading section that reads the other side of the transported document G. That is, the scanner 10 is able to read both sides of the document G by using the first reading section 16 and the second reading section 27.

Figure 5:
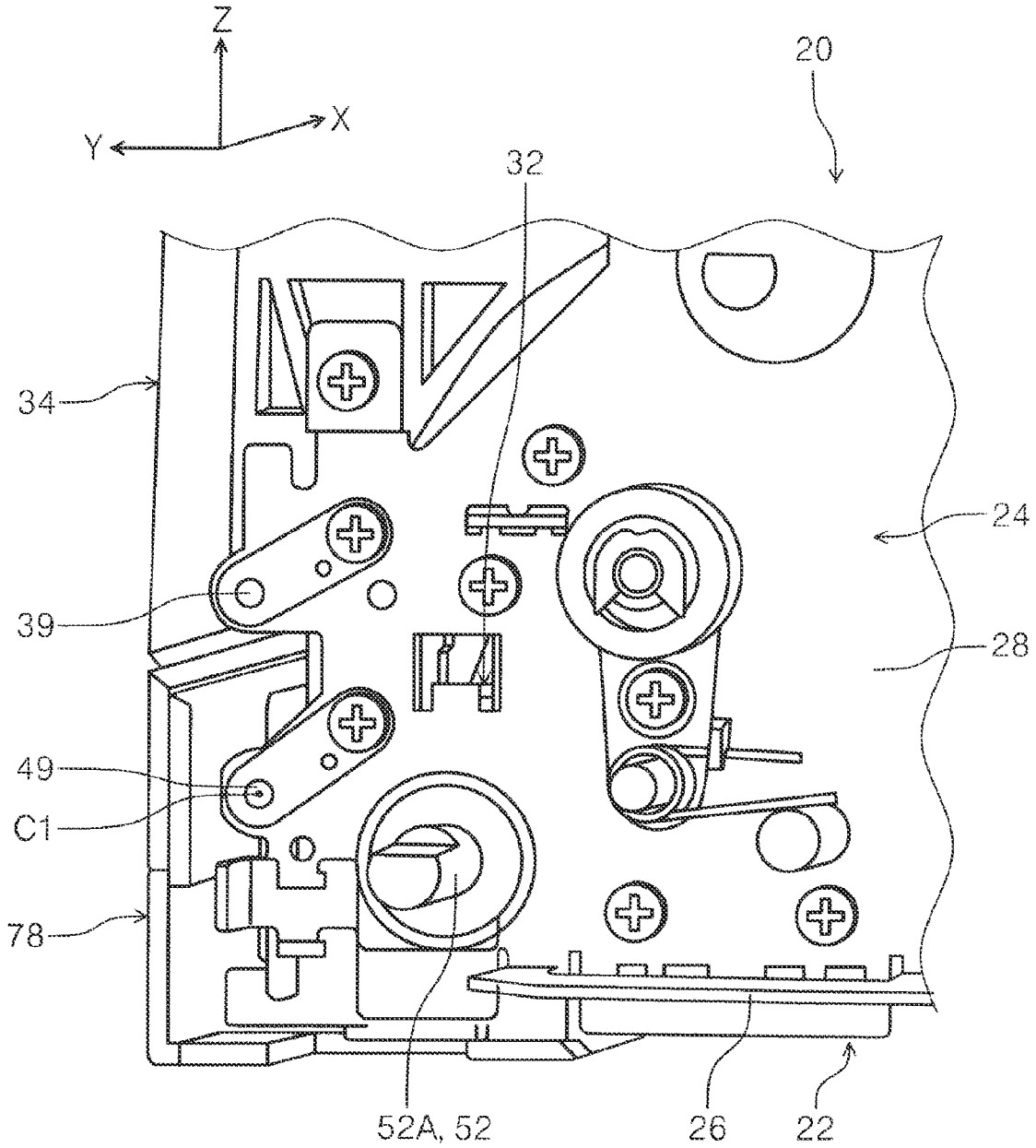
FIG. 5 is a perspective view illustrating a side plate of the document transporting device and respective sections provided in the side plate.

As illustrated in FIG. 5, the frame member 24 includes a bottom portion 26 that extends in the X-Y plane and a side wall 28 that has a plate shape and stands upright in the Z direction in both ends of the bottom portion 26 in the X direction.

The bottom portion 26 is provided with a mat 29 (FIG. 4) that presses the document G mounted on the document platen glass 15 (FIG. 4). The mat 29 is not provided in the +Y direction end of the main body unit 22.

The side wall 28 supports, for example, a first rotational shaft 86 and a third rotational shaft 42 (FIG. 6) described later so as to be rotatable.

The frame member 24 includes a restricting section 32.

The restricting section 32 is formed by, for example, cutting the side wall 28 and bending up the cut portion. In other words, the restricting section 32 is a section that protrudes from the frame member 24 to the center in the X direction. In an instance in which the roller supporting unit 102 (FIG. 4) described later rotates in a direction in which the driven roller 54 described later moves away from the transport roller 52, when a protrusion 93 (FIG. 6) described later comes into contact with the restricting section 32, the restricting section 32 indirectly restricts the rotational amount of the roller supporting unit 102. By restricting the rotational amount of the roller supporting unit 102, the restricting section 32 restricts a dimension of a space of a portion of the inverting path T (FIG. 4) to be equal to or more than a dimension corresponding to a thickness of the document G.

Figure 6:
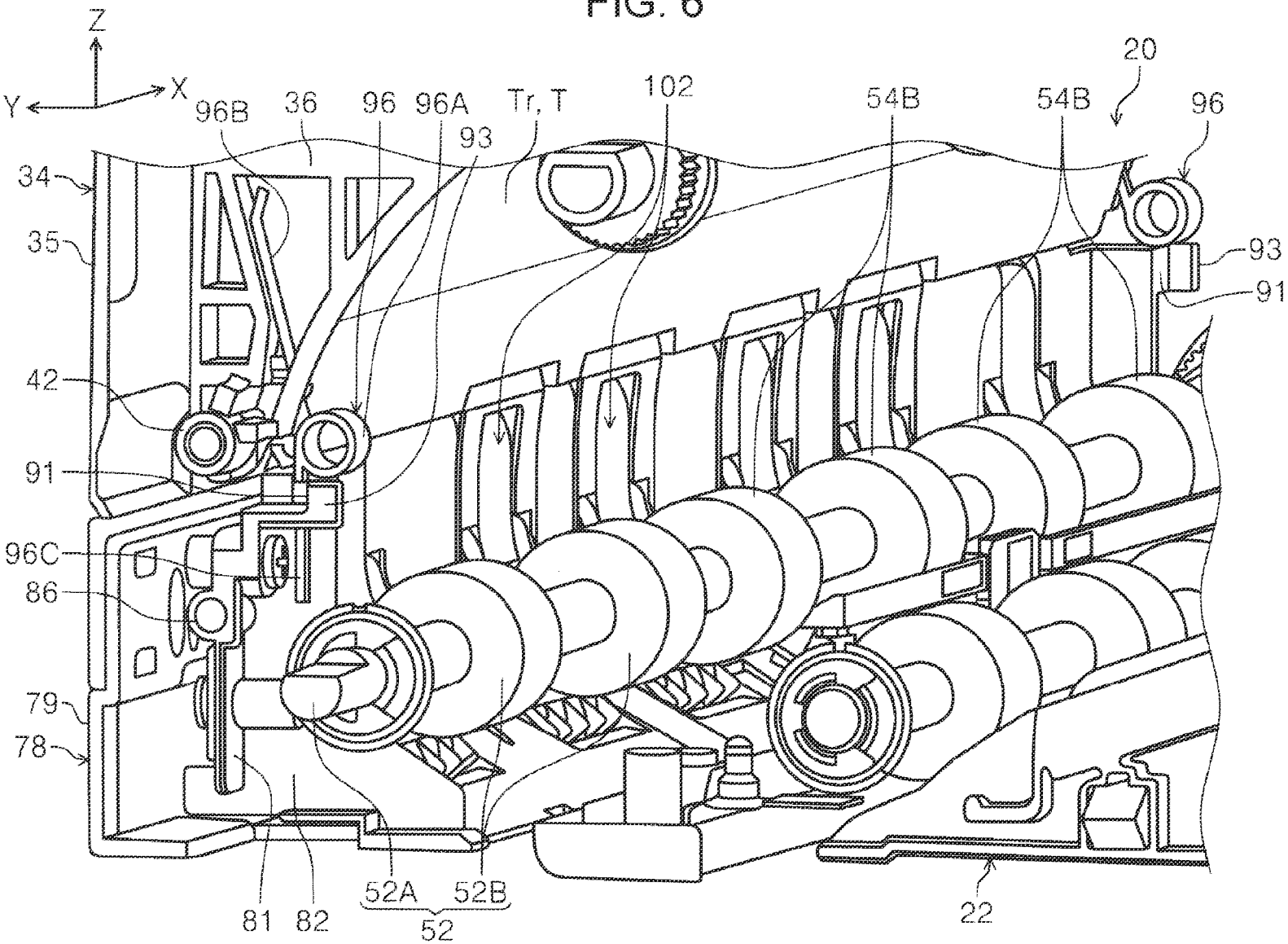
FIG. 6 is a perspective view illustrating a state in which a guide frame of the document transporting device is removed.

As illustrated in FIG. 6, the transport roller 52 is an example of an inner roller provided in the main body unit 22 (FIG. 5) inside the inverting path T. When driven by a motor (not illustrated), the transport roller 52 transports the document G to a portion downstream in the transport direction. The transport roller 52 includes, for example, a rotational shaft section 52A that has a substantially column-like shape extending in the X direction and an elastic section 52B that has a cylindrical shape having an outer diameter greater than that of the rotational shaft section 52A. For example, six elastic sections 52B are provided on the rotational shaft section 52A at intervals in the X direction.

Figure 10:
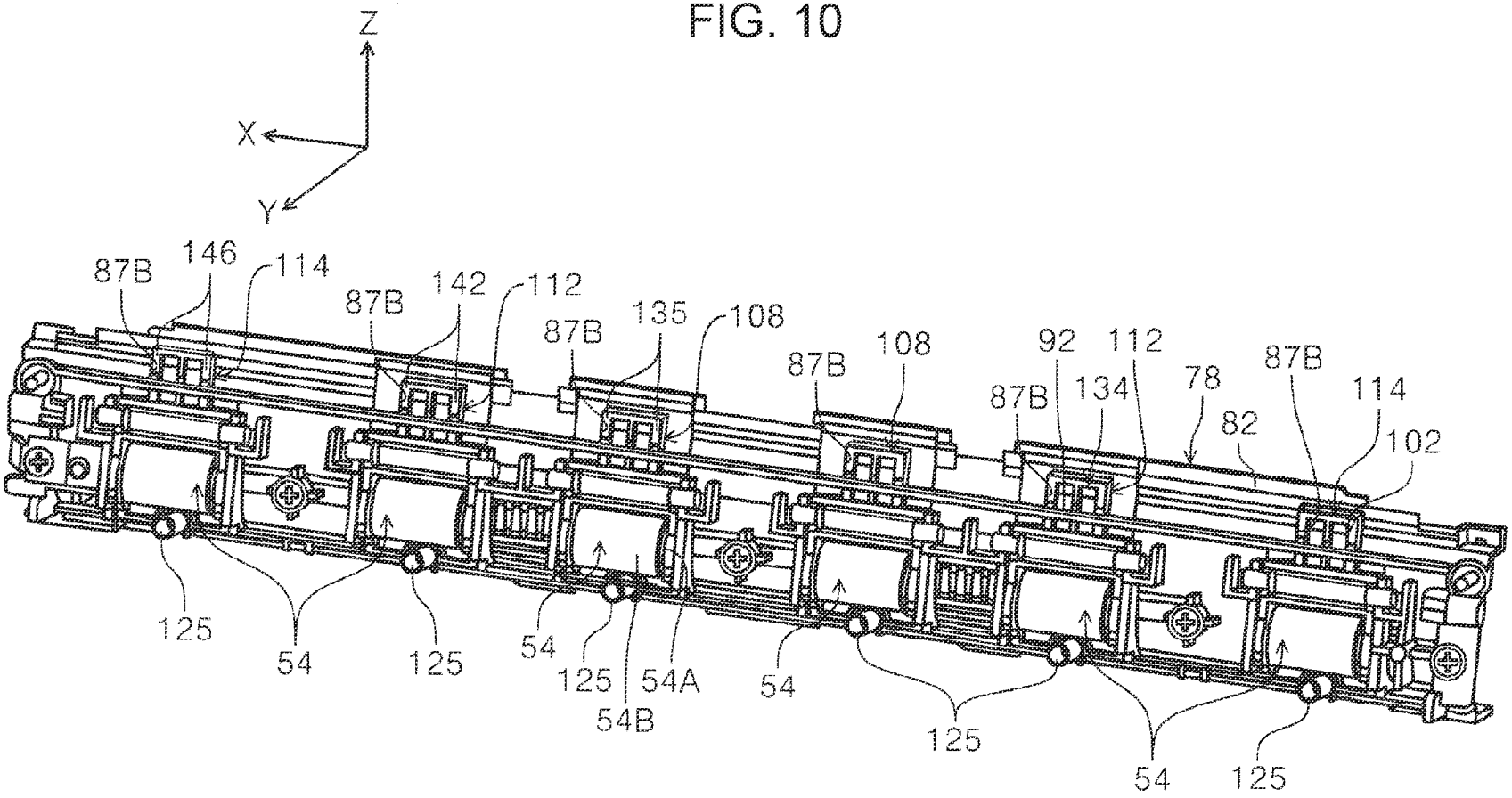
FIG. 10 is a perspective view of the third unit, the supporting unit, and a driven roller.

As illustrated in FIG. 10, the driven roller 54 is an example of an outer roller provided in the roller supporting unit 102 described later outside the inverting path T. For example, six driven rollers 54 are provided at intervals in the X direction. The driven roller 54 is located outside the arc portion Tr (FIG. 4). When rotated in accordance with rotation of the transport roller 52 (FIG. 4), the driven roller 54 is able to transport the document G. The driven roller 54 includes, for example, a rotational shaft section 54A that has a column shape extending in the X direction and a cylindrical portion 54B that has an outer diameter greater than that of the rotational shaft section 54A.

As illustrated in FIG. 6, the cover unit 34 is an example of a second unit and forms the outer side in the arc portion Tr. Specifically, the cover unit 34 includes a cover 35 having an L-shaped sectional surface when viewed in the X direction and a cover main body 36 provided inside the cover 35.

The cover main body 36 is constituted by a member having a rectangular parallelepiped shape extending in the X direction, a portion of which is cut off to form an arc shape. The third rotational shaft 42 having a bottomed cylindrical shape that is open to the outside in the X direction is provided in each end of the cover main body 36 in the X direction.

The third rotational shaft 42 has a shaft center extending in the X direction. When a pin 39 (FIG. 5) provided in the main body unit 22 is inserted, the third rotational shaft 42 is rotatably supported by the main body unit 22. In this manner, the cover unit 34 is provided so as to be rotatable about the third rotational shaft 42.

As illustrated in FIGS. 1 and 2, the cover unit 34 can be in a closed state for forming the inverting path T (FIG. 2) and an open state for exposing the inverting path T.

As illustrated in FIG. 2, the cover unit 34 includes a lock member 38 and an unlock lever 41. When the unlock lever 41 is lifted, the cover unit 34 in the closed state is unlocked, and the cover unit 34 is brought into the open state.

When retreating from the main body unit 22, the cover unit 34 exposes, in +Z direction, a portion of the inverting path T in the transport direction of the document G. As described later, the cover unit 34 is able to apply a pressing force to the roller supporting unit 102 (FIG. 4) in accordance with the exposing operation of the cover unit 34.

As illustrated in FIG. 4, the cover unit 34 includes a pick roller 44 and a feeding roller 46.

The pick roller 44 feeds the document G mounted on the document mounting section 23 in accordance with rotation.

The feeding roller 46 forms the separation roller pair 45 together with a separation roller 47 provided in the main body unit. A first roller pair 48 is provided downstream of the separation roller pair 45 on the inverting path T.

The first roller pair 48 is constituted by a lower roller 48A driven by a motor (not illustrated) and an upper roller 48B capable of being driven to rotate.

The document G is curved downward in a portion downstream of the first roller pair 48 on the inverting path T. A second roller pair 51 is provided downstream of the first roller pair 48.

The second roller pair 51 is constituted by the transport roller 52 and the driven roller 54 described above. The second roller pair 51 nips and transports the document G downstream of a position at which the side of the document G, which faces down, is inverted so as to face up on the inverting path T, that is, a position furthest in the +Y direction on the inverting path T.

The document G fed from the document mounting section 23 is curved downward by the inverting path T and then returned in a direction opposite to a direction in which the document G is fed from the document mounting section 23. The returned document G passes through a region facing the first reading section 16 that is stopped and then reaches a third roller pair 56.

The third roller pair 56 is constituted by a drive roller 56A driven by a motor (not illustrated) and a roller 56B capable of being driven to rotate. The document G transported by the third roller pair 56 passes through a region facing the second reading section 27 and reaches the discharge roller pair 58.

The discharge roller pair 58 is constituted by a drive roller 58A driven by a motor (not illustrated) and a roller 58B capable of being driven to rotate. The document G is discharged by the discharge roller pair 58 to the document discharge section 25.

Figure 7:
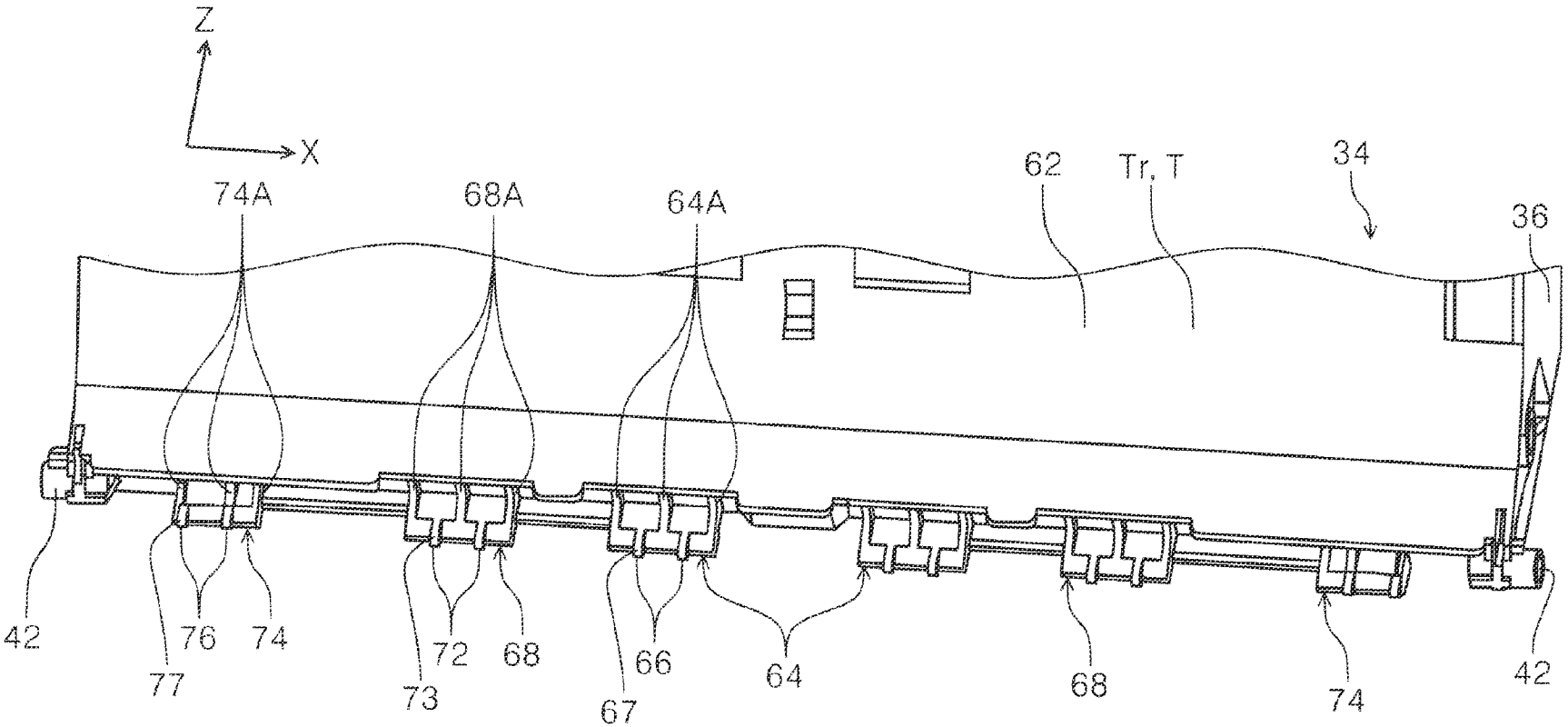
FIG. 7 is a perspective view of an upper guide frame of the cover unit.

As illustrated in FIG. 7, the cover main body 36 has a curved surface 62 that forms an outer wall surface which is on the upper side with respect to the center of the inverting path T in the Z direction. Two sets of first extending sections 64, two sets of second extending sections 68, and two sets of second extending sections 74 are provided in the −Z direction end of the cover main body 36.

The two sets of first extending sections 64 are located symmetrically about the center of the cover main body 36 in the X direction such that one is located on the +X direction side and the other is located on the −X direction side, and the two sets of second extending sections 68 and the two sets of second extending sections 74 are located in the same manner. Moreover, the two sets of first extending sections 64, the two sets of second extending sections 68, and the two sets of second extending sections 74 each extend in the −Z direction from a portion of the cover main body 36, which is located in the +Y direction and the −Z direction with respect to the curved surface 62. Note that a description will be given by assuming that the positions of the respective sections of the cover main body 36 are positions when the cover unit 34 is in the closed state.

A first extending section 64 is a plate-like section extending in the −Z direction from the cover main body 36. The first extending section 64 is located on the center side of the cover main body 36 in the X direction. The first extending section 64 is reinforced by, for example, three ribs 64A located at intervals in the X direction. Two first contacting sections 66 capable of coming into contact with the roller supporting unit 102 (FIG. 4) described later are provided in the −Z direction end of the first extending section 64.

A first contacting section 66 is a protrusion that protrudes in the −Z direction from the −Z direction end of the first extending section 64. The first contacting section 66 has, for example, a first contacting surface 67 that is a curved surface.

The first contacting surface 67 is a surface that comes into contact with a first contact section 135 (FIG. 10) described later when the cover unit 34 is rotated to be in the open state.

A second extending section 68 is a plate-like section extending in the −Z direction from the cover main body 36. The second extending section 68 is located outside the first extending section 64 in the X direction. The second extending section 68 is reinforced by, for example, three ribs 68A located at intervals in the X direction. Two second contacting sections 72 capable of coming into contact with the roller supporting unit 102 (FIG. 4) described later are provided in the −Z direction end of the second extending section 68.

A second contacting section 72 is a protrusion that protrudes in the −Z direction from the −Z direction end of the second extending section 68. The second contacting section 72 has, for example, a second contacting surface 73 that is a curved surface.

The second contacting surface 73 is a surface that comes into contact with a second contact section 142 (FIG. 10) described later when the cover unit 34 is rotated to be in the open state.

A second extending section 74 is a plate-like section extending in the −Z direction from the cover main body 36. The second extending section 74 is located outside the second extending section 68 in the X direction. The second extending section 74 is reinforced by, for example, three ribs 74A located at intervals in the X direction. Two second contacting sections 76 capable of coming into contact with the roller supporting unit 102 (FIG. 4) described later are provided in the −Z direction end of the second extending section 74.

A second contacting section 76 is a protrusion that protrudes in the −Z direction from the −Z direction end of the second extending section 74. The second contacting section 76 has, for example, a second contacting surface 77 that is a curved surface.

The second contacting surface 77 is a surface that comes into contact with a second contact section 146 (FIG. 10) described later when the cover unit 34 is rotated to be in the open state.

Figure 8:
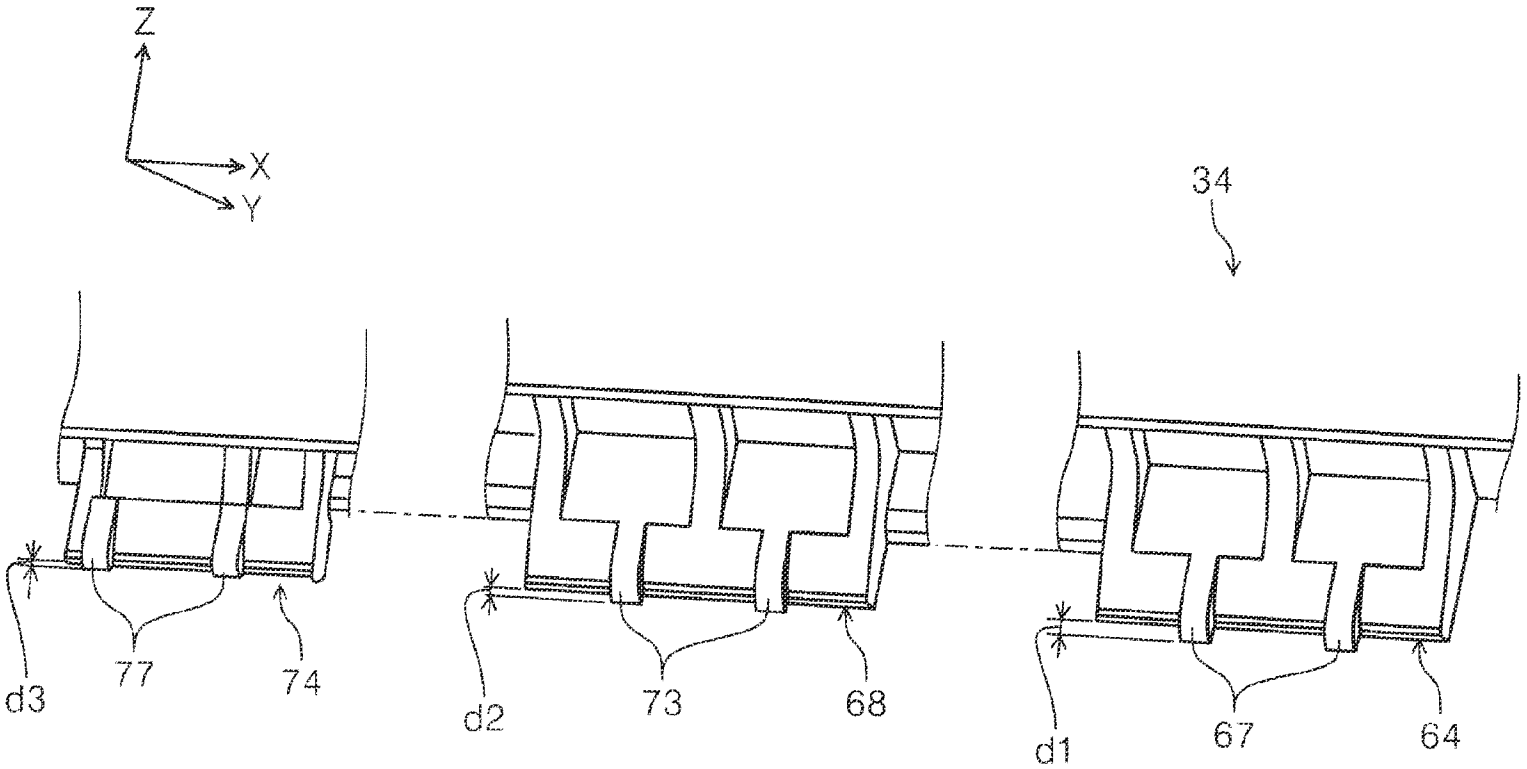
FIG. 8 is a perspective view illustrating a contacting section of the cover unit in an enlarged manner.

As illustrated in FIG. 8, a portion of the first contacting surface 67 is located downstream of a portion of each of the second contacting surfaces 73 and 77 in the −Y direction, which is an example of a movement direction in which the cover unit 34 approaches an inner unit 108, an intermediate unit 112, and an outer unit 114 (FIG. 10) described later. Moreover, the second contacting surface 73 is located downstream of the second contacting surface 77 in the −Y direction of the cover unit 34. In other words, when an amount by which the first contacting surface 67 protrudes from the first extending section 64 is d1 [mm], an amount by which the second contacting surface 73 protrudes from the second extending section 68 is d2 [mm], and an amount by which the second contacting surface 77 protrudes from the second extending section 74 is d3 [mm], for example, d1>d2>d3 is satisfied.

As illustrated in FIG. 6, the movable unit 78 is an example of a third unit and is located in the −Z direction with respect to the cover unit 34. The movable unit 78 forms the outer side in the arc portion Tr in a portion downstream of the cover unit 34 in the transport direction of the document G. The movable unit 78 is provided so as to be rotatable about the first rotational shaft 86 such that the movable unit 78 is able to be reciprocated with respect to the main body unit 22. By receiving a force from the roller supporting unit 102 described later, the movable unit 78 is able to rotate in a direction in which the movable unit 78 retreats from the main body unit 22.

The movable unit 78 specifically includes an outer cover 79 having an L-shaped sectional surface when viewed in the X direction, an inner cover 81 provided inside the outer cover 79, and a main body section 82 a portion of which is covered by the inner cover 81 when viewed in the −Y direction.

Figure 12:
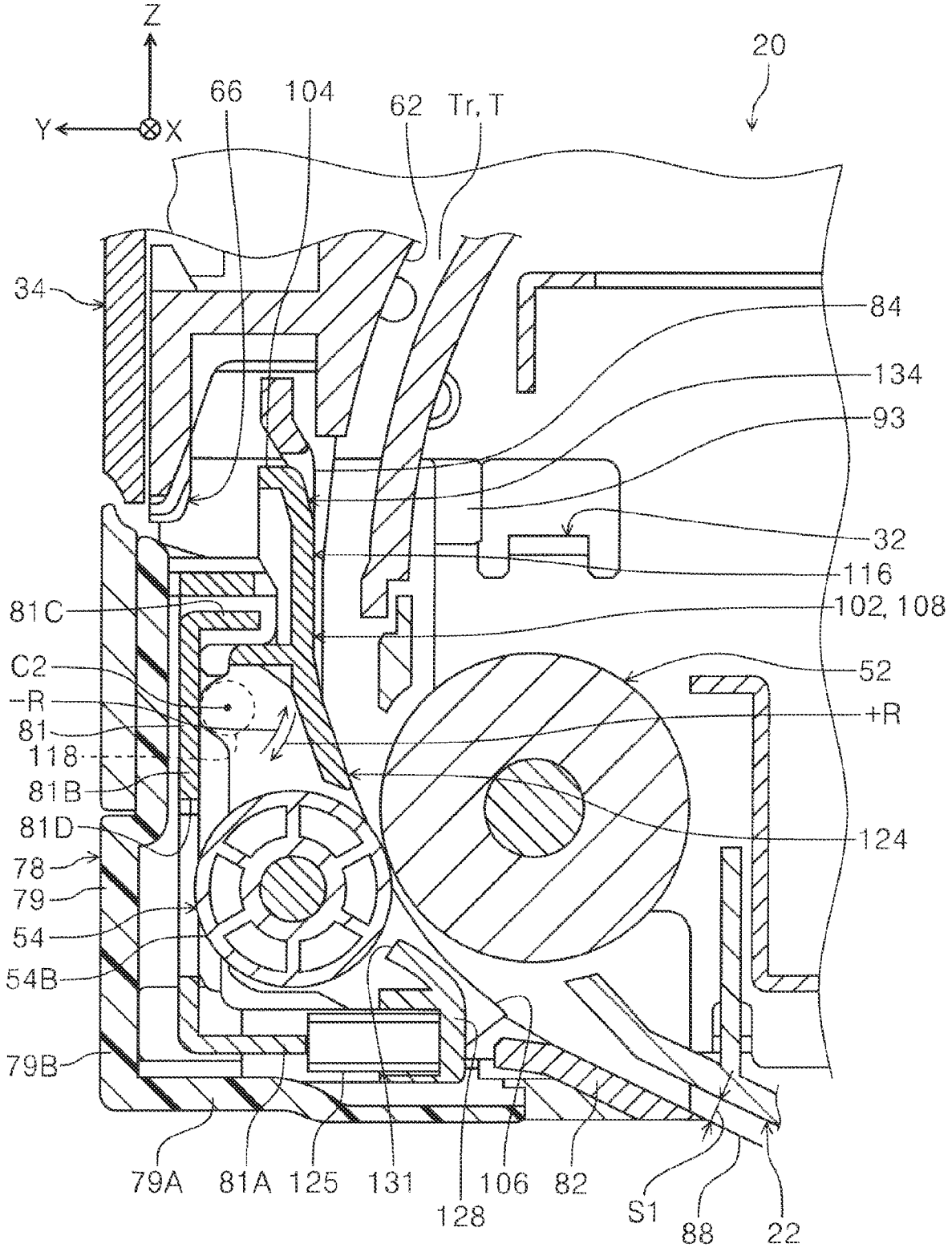
FIG. 12 is a vertical sectional view of a portion of the document transporting device in the state in which both of the document transporting device and the cover unit are closed.

As illustrated in FIG. 12, the outer cover 79 is made of, for example, resin and attached to the +Y direction end of the main body section 82 described later. The outer cover 79 has the bottom wall 79A that has a plate shape having a predetermined thickness in the Z direction and a longitudinal wall 79B that stands upright in the +Z direction in the +Y direction end of the bottom wall 79A.

The inner cover 81 is made of, for example, metal and attached to the main body section 82. The inner cover 81 includes a bottom plate 81A having a predetermined thickness in the Z direction, a longitudinal plate 81B that stands upright in the +Z direction in the +Y direction end of the bottom plate 81A, and an upper plate 81C that extends in the −Y direction from the +Z direction end of the longitudinal plate 81B. A window 81D passes through the longitudinal plate 81B in the Y direction.

The cylindrical portion 54B of the driven roller 54 is exposed through the window 81D in the +Y direction.

As illustrated in FIG. 6, the main body section 82 is constituted by a member having a rectangular parallelepiped shape extending in the X direction, a portion of which is cut off to form an arc shape. The first rotational shaft 86 having a bottomed cylindrical shape that is open to the outside in the X direction is provided in each end of the main body section 82 in the X direction.

The first rotational shaft 86 has a shaft center extending in the X direction. When a pin 49 (FIG. 5) provided in the main body unit 22 is inserted, the first rotational shaft 86 is rotatably supported by the main body unit 22. In this manner, the movable unit 78 is provided so as to be rotatable about the first rotational shaft 86. For example, the first rotational shaft 86 is arranged adjacent to the third rotational shaft 42 in the Z direction and located in the −Z direction with respect to the third rotational shaft 42.

For example, a longitudinal wall 91 and a protrusion 93 are provided in each end of the main body section 82 in the X direction.

The longitudinal wall 91 protrudes outward in the X direction at a position in the −Y direction and the +Z direction with respect to the first rotational shaft 86 in the main body section 82. The longitudinal wall 91 has a plate shape having a predetermined thickness in the Y direction.

The protrusion 93 is a portion that protrudes in the −Y direction from an outer end of the longitudinal wall 91 in the X direction. The protrusion 93 has a plate shape having a predetermined thickness in the X direction. When the movable unit 78 rotates, the protrusion 93 comes into contact with the restricting section 32 (FIG. 5) such that movement of the protrusion 93 is restricted.

Figure 9:
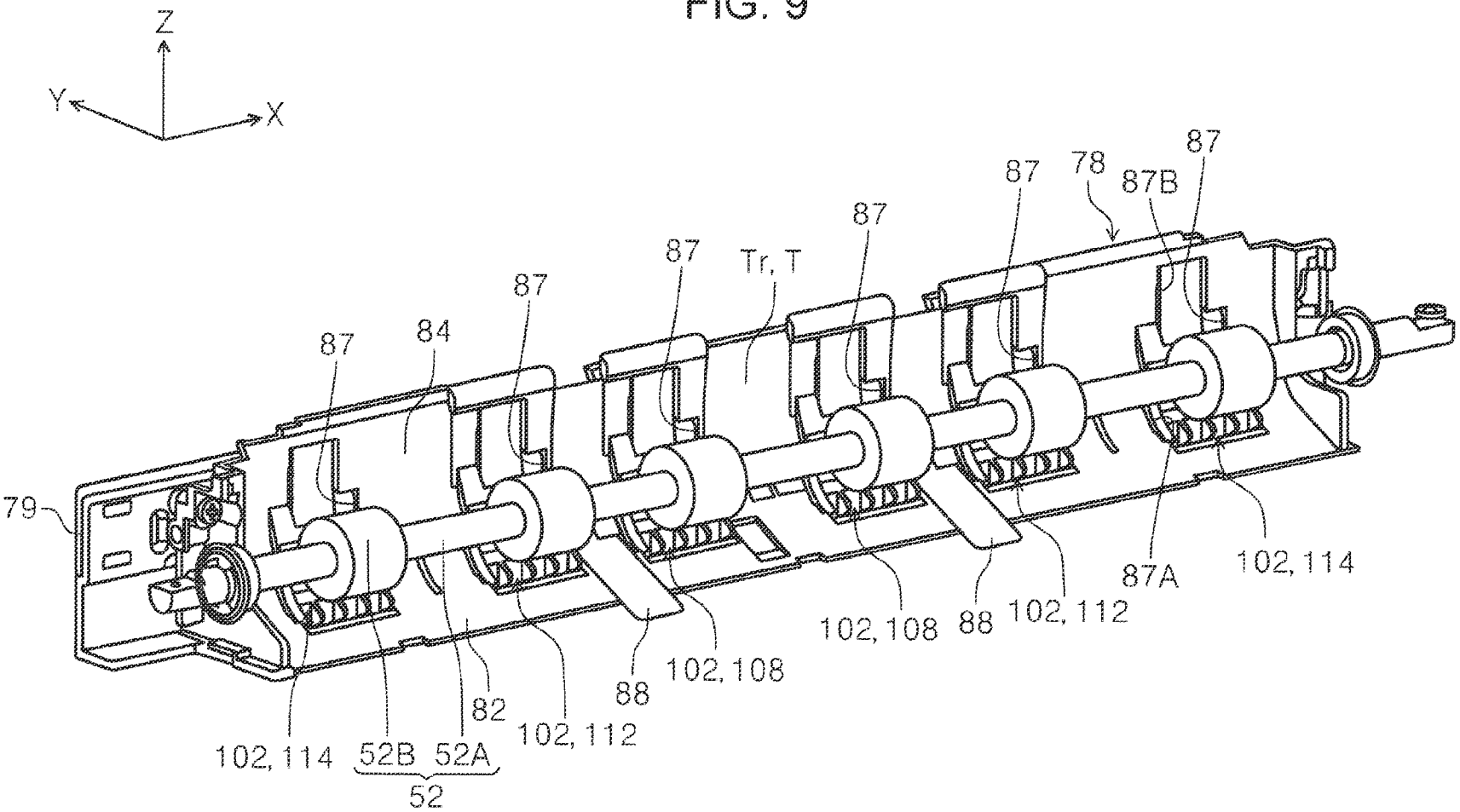
FIG. 9 is a perspective view of a third unit, a supporting unit, and a transport roller.

As illustrated in FIG. 9, the main body section 82 of the movable unit 78 has a path surface 84 that forms a portion of the inverting path T. Moreover, for example, six holes 87 are formed in the main body section 82 at intervals in the X direction.

The path surface 84 is, for example, a curved surface and forms a portion of the arc portion Tr.

The respective six holes 87 pass through the main body section 82 in a direction intersecting the path surface 84. A single roller supporting unit 102 described later is accommodated in each of the six holes 87. The hole 87 is constituted by a wide portion 87A that is wide in the X direction when viewed in a direction in which the hole 87 extends and a narrow portion 87B that is located in the +Z direction with respect to the wide portion 87A and that is narrower than the wide portion 87A in the X direction.

For example, two sheet members 88 are each provided in a portion of the path surface 84, which is located between adjacent holes 87.

A sheet member 88 extends downstream of the movable unit 78 in the transport direction from a portion located between adjacent holes 87, that is, adjacent roller supporting units 102. That is, one end of the sheet member 88 extends downstream of the main body section 82 in the transport direction. In the present embodiment, for example, the two sheet members 88 are provided at an interval in the X direction. Specifically, each of the sheet members 88 is provided between the inner unit 108 and the intermediate unit 112, which will be described later.

As illustrated in FIG. 10, a regulating section 92 is provided in the +Y direction end of the main body section 82, which corresponds to a portion on the rear side of the main body section 82.

The regulating section 92 is located in the +Y direction with respect to the narrow portion 87B. The regulating section 92 linearly extends in the X direction so as to extend across six narrow portions 87B. The regulating section 92 is, for example, a plate-like section having a predetermined thickness in the Z direction. When a second extension section 134 of the roller supporting unit 102, which will be described later, comes into contact with the regulating section 92, the regulating section 92 regulates the second extension section 134 so as not to move more than necessary in the +Y direction.

Figure 11:
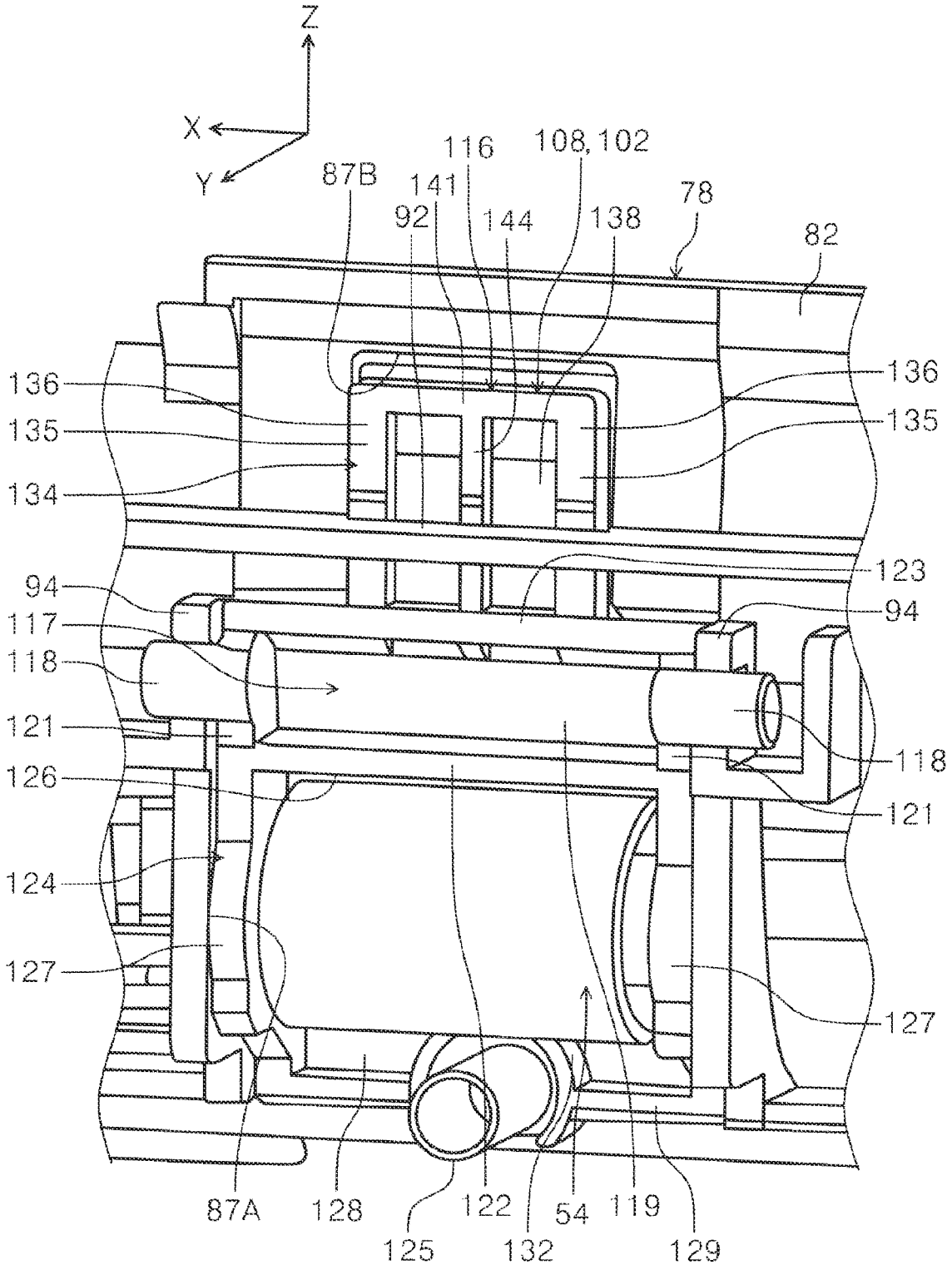
FIG. 11 is a perspective view illustrating the third unit, the supporting unit, and the driven roller in an enlarged manner.

As illustrated in FIG. 11, a bearing 94 is provided in each edge of the wide portion 87A in the X direction so as to be located in the −Z direction with respect to the regulating section 92 in the main body section 82.

The bearing 94 is a portion cut into a C shape that is open in the +Y direction when viewed in the X direction and supports a second rotational shaft 118 described later so as to be rotatable.

As illustrated in FIG. 6, for example, two torsion springs 96 are provided so as to be located in both ends of the document transporting device 20 in the X direction.

A torsion spring 96 includes a winding section 96A, a linear portion 96B extending in one direction from the winding section 96A, and a linear portion 96C extending in another direction from the winding section 96A.

The linear portions 96B come into contact, in the +Y direction, with the respective ends of the cover unit 34 in the X direction. The linear portions 96C come into contact with the +Y direction side surfaces of the longitudinal walls 91 of the movable unit 78.

Regardless of whether the cover unit 34 is in the open state or the closed state, the two torsion springs 96 apply a pressing force, which is an elastic force, to the movable unit 78 and the cover unit 34.

A pressing force applied by the two torsion springs 96 to the movable unit 78 when the cover unit 34 is in the closed state is a first pressing force F1 [N]. A pressing force applied by the two torsion springs 96 to the movable unit 78 when the cover unit 34 is in the open state is a second pressing force F2 [N]. Here, the first pressing force F1>the second pressing force F2 is satisfied. The pressing force is realized by the pressing force of the torsion springs 96 and an elastic force of a coil spring 125 described later. Note that neither the first pressing force F1 nor the second pressing force F2 is illustrated.

As illustrated in FIG. 10, the roller supporting unit 102 is an example of a supporting unit that supports the driven roller 54 so as to be rotatable. The roller supporting unit 102 is constituted by, for example, two inner units 108 located on the center side in the X direction, two intermediate units 112 located outside the respective inner units 108 in the X direction, and two outer units 114 located outside the respective intermediate units 112 in the X direction. That is, the inner unit 108, the intermediate unit 112, and the outer unit 114 are located in this order from the center in the X direction toward the outside, that is, toward each of the +X direction side and the −X direction side.

The inner unit 108 is an example of a first supporting unit. The intermediate unit 112 and the outer unit 114 are examples of a second supporting unit. Note that, regarding the intermediate unit 112 and the outer unit 114, the intermediate unit 112 may be an example of the first supporting unit, and the outer unit 114 may be an example of the second supporting unit.

In the present embodiment, for example, the inner unit 108, the intermediate unit 112, and the outer unit 114 are configured to have a similar shape and a similar size. Accordingly, in the following description, a specific configuration of the roller supporting unit 102 will be described by taking the inner unit 108 as an example, and description of the intermediate unit 112 and the outer unit 114 will be omitted in some cases. Moreover, the inner unit 108 will be described simply as the roller supporting unit 102 in some cases.

The inner unit 108 includes the first contact section 135. The first contacting section 66 (FIG. 7) is able to come into contact with the first contact section 135.

The intermediate unit 112 includes the second contact section 142 instead of the first contact section 135 in the inner unit 108. The second contacting section 72 (FIG. 7) is able to come into contact with the second contact section 142.

The outer unit 114 includes the second contact section 146 instead of the first contact section 135 in the inner unit 108. The second contacting section 76 (FIG. 7) is able to come into contact with the second contact section 146.

FIG. 11 illustrates the inner unit 108 in an enlarged manner as an example of the roller supporting unit 102. The inner unit 108 is constituted by a swinging member 116.

The swinging member 116 supports the driven roller 54 so as to be rotatable. The swinging member 116 is provided so as to be rotatable about the second rotational shaft 118.

The swinging member 116 forms the outer side in the arc portion Tr (FIG. 4) of the inverting path T. By receiving a force from the cover unit 34 (FIG. 4), the swinging member 116 is able to rotate about the second rotational shaft 118 in a direction in which the driven roller 54 moves away from the transport roller 52 (FIG. 4).

The swinging member 116 includes the second rotational shaft 118 supported by a base section 117 when viewed in the X direction, a first extension section 124 that extends in one direction, that is, the −Z direction, from the second rotational shaft 118 and supports the driven roller 54, and the second extension section 134 that extends in another direction, that is, the +Z direction, from the second rotational shaft 118 and is able to come into contact with the cover unit 34 (FIG. 4).

The base section 117 includes, for example, a first guide wall 119, two first side walls 121, a first lower wall 122, and a first upper wall 123. The base section 117 has a box shape that has the first guide wall 119 as a bottom and is open in the +Y direction.

The first guide wall 119 is a rectangular wall having a dimension in the X direction longer than a dimension in the Z direction and forms a portion of the outer side of the inverting path T (FIG. 4).

The two first side walls 121 stand upright in the +Y direction from the respective X direction ends of the first guide wall 119. The first lower wall 122 stands upright in the +Y direction from the −Z direction end of the first guide wall 119. The first upper wall 123 stands upright in the +Y direction from the +Z direction end of the first guide wall 119.

The second rotational shaft 118 is a column portion having a shaft center extending in the X direction. The second rotational shaft 118 extends outward in the X direction from the respective two first side walls 121. As described above, the second rotational shaft 118 is rotatably supported by the bearing 94.

The first extension section 124 includes, for example, two second side walls 127, a second guide wall 128, and a second lower wall 129.

The two second side walls 127 are walls extending in the −Z direction from the −Z direction ends of the respective two first side walls 121. The two second side walls 127 support the respective X direction ends of the driven roller 54 so as to be rotatable.

The second guide wall 128 is a rectangular wall having a dimension in the X direction longer than a dimension in the Z direction and forms a portion of the outer side of the inverting path T (FIG. 4). The second guide wall 128 couples, in the X direction, the −Y direction ends in the −Z direction ends of the respective two second side walls 127. The second guide wall 128 is located in the −Z direction with respect to the first guide wall 119. In other words, the second guide wall 128 is located downstream of the first guide wall 119 in the transport direction of the document G. A portion between the first guide wall 119 and the second guide wall 128 is an opening 131 (FIG. 12). The driven roller 54 is exposed to the inverting path T through the opening 131.

The second lower wall 129 couples the −Z direction ends of the respective two side walls 127 and the −Z direction end of the second guide wall 128. A protective section 132 is provided on the second lower wall 129 and the second guide wall 128.

The protective section 132 is a half-cylindrical section that extends in the Y direction and is open in the +Y direction and the −Z direction. The coil spring 125 described later is located inside the protective section 132.

An accommodating section 126 is constituted by the first extension section 124 and the first lower wall 122. The accommodating section 126 is a space in which the driven roller 54 is accommodated.

The second extension section 134 includes, for example, two third side walls 136, a third guide wall 138, a second upper wall 141, and a rib 144. The dimension of the second extension section 134 in the Z direction is, for example, shorter than the dimension of the first extension section 124 in the Z direction. The width of the second extension section 134 in the X direction is narrower than the width of the first extension section 124 in the X direction.

The respective two third side walls 136 are walls extending in the +Z direction from the first upper wall 123.

The third guide wall 138 couples the two third side walls 136 in the X direction and forms a portion of the outer side of the inverting path T (FIG. 4). The third guide wall 138 is located in the +Z direction with respect to the first guide wall 119. In other words, the third guide wall 138 is located upstream of the first guide wall 119 in the transport direction of the document G.

The second upper wall 141 couples the +Z direction ends of the two third side walls 136 in the X direction.

The rib 144 protrudes in the +Y direction from the third guide wall 138 between the two third side walls 136 and reinforces the second extension section 134.

The second extension section 134 is able to come into contact with the cover unit 34 (FIG. 4). Specifically, the first contact section 135 is provided in the +Z direction end of the second extension section 134.

The first contact section 135 is constituted by a portion of each of the two third side walls 136, which is located in the +Z direction with respect to the center in the Z direction. When the cover unit 34 is in the closed state, the +Y direction end surface of the first contact section 135 is arranged in, for example, the X-Z plane.

A portion of the second extension section 134, which is farther than the first contact section 135 in the −Z direction, is located so as to be able to come into contact with the regulating section 92.

As illustrated in FIG. 12, when the second extension section 134 receives a pressing force from the first contacting section 66 in the −Y direction, the second extension section 134 is moved to the transport roller 52. The first extension section 124 is moved in a direction in which the driven roller 54 moves away from the transport roller 52. That is, the swinging member 116 rotates in direction +R.

When the first contacting section 66 retreats from the second extension section 134 in the +Y direction, the second extension section 134 is moved so as to separate from the transport roller 52 due to operation of the torsion spring 96 (FIG. 6) and the coil spring 125 described later. The first extension section 124 is moved in a direction in which the driven roller 54 approaches the transport roller 52. That is, the swinging member 116 rotates in direction −R.

The inner unit 108 includes the coil spring 125, which is an example of an elastic member.

The coil spring 125 is held by the second guide wall 128 of the first extension section 124 and the bottom plate 81A of the movable unit 78 in the Y direction. In a state in which the cover unit 34 forms the outer side of the inverting path T, that is, when the cover unit 34 is in the closed state, the coil spring 125 applies an elastic force to the roller supporting unit 102 such that the driven roller 54 approaches the transport roller 52.

When viewed in the X direction, the center of the second rotational shaft 118 is a rotational center C2. In the present embodiment, the position of a rotational center C1 (FIG. 5) of the movable unit 78 substantially coincides with the position of the rotational center C2 of the swinging member 116 when viewed in the X direction.

When the cover unit 34 is in the closed state, in other words, when the document G is transported on the inverting path T, an upstream end 104 of the roller supporting unit 102 in the transport direction is located farther than the path surface 84 of the movable unit 78, which forms the inverting path T, from the main body unit 22.

When the document G is transported on the inverting path T, a downstream end 106 of the roller supporting unit 102 in the transport direction is at a position closer than the path surface 84 to the main body unit 22. In other words, the downstream end 106 protrudes farther than the path surface 84 to the inverting path T.

A state illustrated in FIG. 4 in which the apparatus main body section 21 closes the upper surface 14 of the apparatus lower portion 12 and in which the cover unit 34 forms the inverting path T is a first setting state of the document transporting device 20.

Moreover, a state in which the apparatus main body section 21 closes the upper surface 14 of the apparatus lower portion 12 and in which the cover unit 34 exposes the inverting path T is a second setting state of the document transporting device 20.

Further, a state in which the apparatus main body section 21 exposes the upper surface 14 of the apparatus lower portion 12 and in which the cover unit 34 exposes the inverting path T is a third setting state of the document transporting device 20.

A space of the inverting path T formed by the main body unit 22 and the movable unit 78 is indicated by S [mm]. In the present embodiment, for example, the space S [mm] is set in a portion which is located downstream of a position at which a nip portion is formed by the transport roller 52 and the driven roller 54 and which corresponds to a downstream end of the movable unit 78.

Note that the space S in the first setting state is a first space S1 [mm], the space S in the second setting state is a second space S2 [mm], and the space S in the third setting state is a third space S3 [mm].

Figure 13:
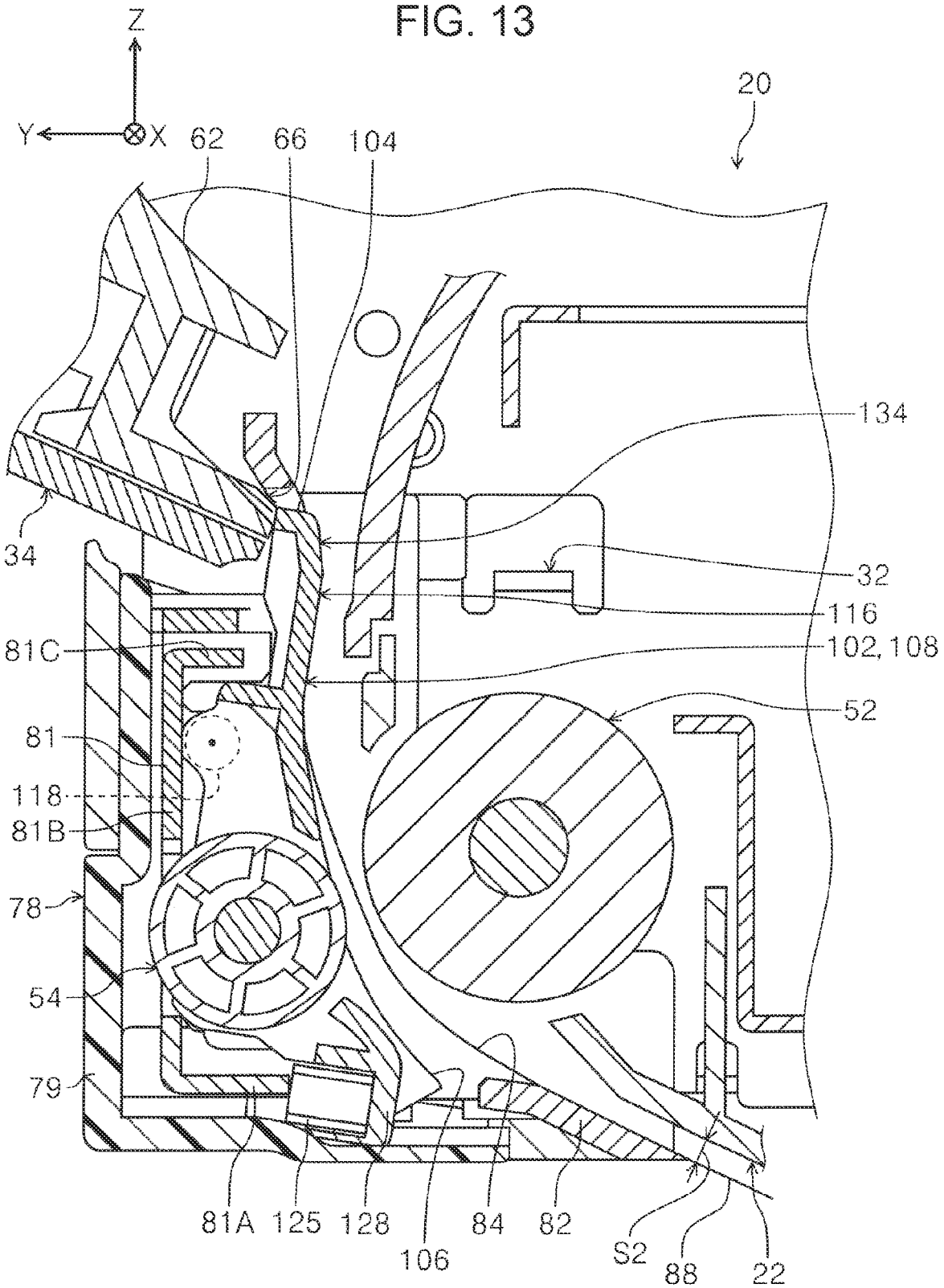
FIG. 13 is a vertical sectional view of a portion of the document transporting device in the state in which the document transporting device is closed and in which the cover unit is open.
Figure 14:
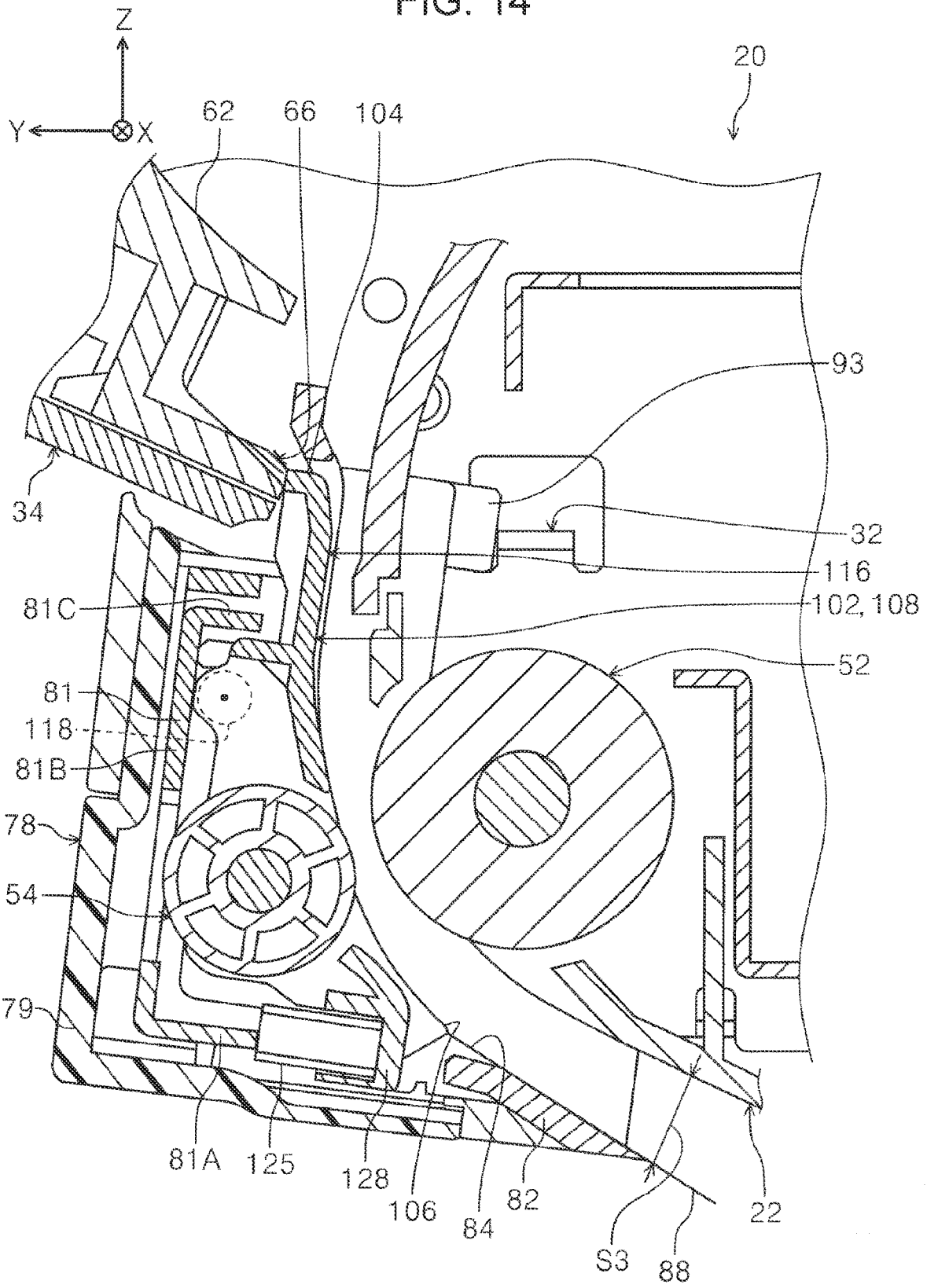
FIG. 14 is a vertical sectional view of a portion of the document transporting device in a state in which both of the document transporting device and the cover unit are open.

As illustrated in FIGS. 12, 13, and 14, the document transporting device 20 is configured such that the second space S2 in the second setting state is wider than the first space S1 in the first setting state. Further, the document transporting device 20 is configured such that the third space S3 in the third setting state is wider than the second space S2.

A difference between the third space S3 and the second space S2 is greater than a difference between the second space S2 and the first space S1.

Next, operation of the scanner 10 will be described. Note that the sections and the members that form the scanner 10 will be described with reference to FIGS. 1 to 14, and description of the drawings will be omitted.

When the cover unit 34 in the closed state is opened, the first contacting section 66 and the first contact section 135 come into contact with each other, the second contacting section 72 and the second contact section 142 come into contact with each other, and the second contacting section 76 and the second contact section 146 come into contact with each other. The roller supporting unit 102 rotates in direction +R about the second rotational shaft 118. As a result, the second extension section 134 of the roller supporting unit 102 moves away from the transport roller 52, and the driven roller 54 moves away from the transport roller 52. At this time, by receiving a pressing force including a +Y direction component from the second extension section 134, the coil spring 125 applies a pressing force including a +Y direction component to the inner cover 81 of the movable unit 78. Further, an angle formed by the linear portion 96B and the linear portion 96C of the torsion spring 96, that is, an opening angle, changes.

Moreover, when the cover unit 34 in the closed state is opened, the change in the opening angle of the torsion spring 96 enables a spring force to be smaller than a spring force when the cover unit 34 is in the closed state. A pressing force including the +Y direction component, which is applied by the torsion spring 96 to the +Z direction end of the movable unit 78, is thereby reduced.

Here, since a repulsion force received from the coil spring 125 is greater than the pressing force applied by the torsion spring 96, the movable unit 78 rotates in a direction away from the transport roller 52. In this manner, a gap between the transport roller 52 and the driven roller 54 increases. Additionally, a space of the inverting path T corresponding to a gap between the main body unit 22 and the movable unit 78 increases in a portion downstream of the transport roller 52 and the driven roller 54 on the inverting path T.

In an instance in which the document transporting device 20 is opened with respect to the apparatus lower portion 12 when the cover unit 34 is in the open state, since regulating rotation of the movable unit 78 performed by the apparatus lower portion 12 is terminated, the movable unit 78 further rotates. The space of the inverting path T thereby further increases.

On the other hand, when the cover unit 34 in the open state is closed, the first contacting section 66, the second contacting section 72, and the second contacting section 76 move away from the first contact section 135, the second contact section 142, and the second contact section 146, respectively. As a result, the pressing force for rotating the roller supporting unit 102 in direction +R is reduced, and the pressing force including the +Y direction component, which is applied by the coil spring 125 to the inner cover 81 of the movable unit 78, is reduced.

Moreover, when the cover unit 34 in the open state is closed, the change in the opening angle of the torsion spring 96 enables the spring force to be greater than the spring force when the cover unit 34 is in the open state. As a result, the pressing force including the +Y direction component, which is applied by the torsion spring 96 to the +Z direction end of the movable unit 78, increases.

Here, since the pressing force applied by the torsion spring 96 becomes greater than the repulsion force received from the coil spring 125, the second extension section 134 of the roller supporting unit 102 rotates in a direction toward the transport roller 52.

In this manner, the transport roller 52 and the driven roller 54 form a nip portion. Additionally, a gap between the main body unit 22 and the movable unit 78 becomes a predetermined gap in a portion downstream of the transport roller 52 and the driven roller 54 on the inverting path T.

As described above, according to the document transporting device 20, when a so-called jam state in which a deformed document G jams on the inverting path T occurs, the cover unit 34 retreats from the main body unit 22, and a portion of the inverting path T is thereby exposed. At this time, the cover unit 34 applies the pressing force to the roller supporting unit 102 in accordance with the exposing operation.

By receiving the force from the cover unit 34, the roller supporting unit 102 rotates about the second rotational shaft 118. The driven roller 54 thereby moves away from the transport roller 52.

By receiving the force from the roller supporting unit 102, the movable unit 78 rotates about the first rotational shaft 86. The movable unit 78 thereby retreats from the main body unit 22.

As described above, in accordance with the exposing operation of the cover unit 34, the roller supporting unit 102 and the movable unit 78 rotate, and, furthermore, the movable unit 78 rotates relative to the roller supporting unit 102. Accordingly, it is possible to easily remove the document G in the jam state from the inverting path T compared with a configuration in which at least one of the roller supporting unit 102 and the movable unit 78 is fixed.

According to the document transporting device 20, since the first extension section 124 is located on one side with respect to the second rotational shaft 118 and the second extension section 134 is located on the other side with respect to the second rotational shaft 118, a direction in which the second extension section 134 receives the pressing force from the cover unit 34 is able to be set to be opposite to a direction in which the first extension section 124 and the driven roller 54 move away from the transport roller 52.

According to the document transporting device 20, in the closed state, since the coil spring 125 applies the elastic force to the roller supporting unit 102, the driven roller 54 approaches the transport roller 52. As a result, a nip pressure applied to the document G is secured in the nip portion formed by the driven roller 54 and the transport roller 52, thus making it possible to suppress a transport failure of the document G in the nip portion from occurring.

According to the document transporting device 20, when a single driven roller 54 is provided, since the driven roller 54 is supported at multiple positions in the X direction, it is possible to suppress the driven roller 54 from being warped. When a plurality of driven rollers 54 are provided, since a gap between supporting points in the X direction, at which the driven rollers 54 are supported by the roller supporting units 102, is small compared with an instance in which a single roller supporting unit 102 is provided, it is possible to suppress the driven roller 54 from being warped.

According to the document transporting device 20, when passing through a portion of the movable unit 78 which forms the inverting path T, a downstream end of the transported document G in the transport direction is guided by the sheet member 88. It is thus possible to stabilize the orientation of the document G transported from the movable unit 78 to a portion downstream in the transport direction.

According to the document transporting device 20, even when the inner unit 108 is located downstream of the intermediate unit 112 and the outer unit 114 in the +Y direction, for example, due to warping of a member that supports the inner unit 108, the intermediate unit 112, or the outer unit 114, since the first contacting surface 67 is located downstream of the second contacting surfaces 73 and 77, a time point when the first contacting surface 67 comes into contact with the first contact section 135 is able to coincide with a time point when the second contacting surfaces 73 and 77 respectively come into contact with the second contact sections 142 and 146.

According to the document transporting device 20, since the upstream end 104 of the roller supporting unit 102 in the transport direction is located farther than the path surface 84 from the main body unit 22 in the +Y direction, when the document G is transported on the inverting path T, a downstream end of the document G in the transport direction is able to be suppressed from being caught by the roller supporting unit 102 compared with a configuration in which the upstream end 104 is located closer than the path surface 84 to the main body unit 22.

According to the document transporting device 20, since the downstream end 106 of the roller supporting unit 102 in the transport direction is located closer than the path surface 84 to the main body unit 22, when the document G is transported on the inverting path T, an upstream end of the document G in the transport direction is readily supported at a high position compared with a configuration in which the downstream end 106 is located farther than the path surface 84 from the main body unit 22. As a result, it is possible to suppress the upstream end of the document G in the transport direction of the document G from vibrating or rebounding when separating from the path surface 84. It is also possible to suppress a great change in the orientation of the document G from occurring when the upstream end of the document G is released from the nip portion formed by the transport roller 52 and the driven roller 54.

According to the document transporting device 20, since the first rotational shaft 86 and the third rotational shaft 42 are supported by the common frame member 24, accuracy in relative positions of the first rotational shaft 86 and the third rotational shaft 42 is enhanced compared with a configuration in which the first rotational shaft 86 and the third rotational shaft 42 are supported by different members. As a result, accuracy in relative positions of the roller supporting unit 102, which is supported by the movable unit 78, and the cover unit 34 is also enhanced, and it is thus possible to suppress a deviation in the position at which the cover unit 34 and the roller supporting unit 102 come into contact with each other from occurring.

According to the document transporting device 20, the restricting section 32 restricts the rotational amount of some roller supporting units 102, and some roller supporting units 102 are thus restricted from excessively approaching the main body unit 22. As a result, it is possible to suppress a portion of the inverting path T, specifically, a region upstream of the driven roller 54 and the transport roller 52 from being reduced more than necessary in accordance with rotation of the roller supporting unit 102.

According to the document transporting device 20, in the second setting state described above, the second space S2 is wider than the first space S1, and the document G is thus easily removed from the inverting path T. In the third setting state described above, the third space S3 is wider than the second space S2, and the document G is thus more easily removed from the inverting path T.

According to the scanner 10, a portion of the document G is suppressed from remaining on the inverting path T when the document G in the jam state is removed from the inverting path T. Accordingly, it is possible to suppress a reading failure of the next document G from occurring when the first reading section 16 and the second reading section 27 perform the operation of reading the next document G.

Although each of the document transporting device 20 and the scanner 10 according to the embodiment of the disclosure basically has the above-described configuration, it is, of course, also possible to, for example, partially change, omit, or combine configurations without departing from the scope of the disclosure of the present application.

In the document transporting device 20, the roller supporting unit 102 may include an extension section that extends in only one direction from the second rotational shaft 118. The coil spring 125 is not necessarily provided as long as the configuration is such that, in the closed state, a force is applied to the roller supporting unit 102 so as to enable the driven roller 54 to approach the transport roller 52. Only a single roller supporting unit 102 may be provided in the X direction.

The sheet member 88 may be formed of any one or both of resin and metal. Moreover, the sheet member 88 is not necessarily provided.

In the document transporting device 20, the first contacting surface 67 may be at the same position as the second contacting surfaces 73 and 77 in a movement direction. The upstream end 104 of the roller supporting unit 102 may be at the same position as the path surface 84 with respect to the main body unit 22. The first rotational shaft 86 and the third rotational shaft 42 may be supported by different members. The restricting section 32 is not necessarily provided. Moreover, the restricting section 32 may be provided in a member different from the frame member 24 of the main body unit 22. The second space S2 and the third space S3 may be equal to each other.

The transport roller 52 is not limited to including six elastic sections 52B in the X direction, and the number of elastic sections 52B in the X direction may be one or more other than six.

The driven roller 54 is not limited to including six cylindrical portions 54B in the X direction, and the number of cylindrical portions 54B in the X direction may be one or more other than six. Note that, when a plurality of cylindrical portions 54B are provided, the number of cylindrical portions 54B is desirably equal to the number of elastic sections 52B. The first rotational shaft 86 and the second rotational shaft 118 may be constituted by using a common single shaft member.

What is claimed is:

1. A medium-transporting device comprising:

a first unit that forms an inner side of an inverting path on which a medium is inverted while being curved;

a second unit that forms an outer side of the inverting path and retreats from the first unit to perform an exposing operation of exposing a portion of the inverting path in a transport direction of the medium;

a third unit that forms the outer side of the inverting path in a portion downstream of the second unit in the transport direction and is provided so as to be rotatable about a first rotational shaft such that the third unit is configured to be reciprocated with respect to the first unit;

an inner roller rotatably provided in the first unit;

at least one outer roller located outside the inverting path and configured to transport the medium by rotating with the inner roller; and at least one supporting unit that supports the outer roller so as to be rotatable, that is provided so as to be rotatable about a second rotational shaft, and that forms the outer side of the inverting path, wherein the second unit is configured to apply a pressing force to the supporting unit in accordance with the exposing operation, the supporting unit is configured to rotate, by receiving a force from the second unit, in a direction in which the outer roller moves away from the inner roller, and the third unit is configured to rotate, by receiving a force from the supporting unit, in a direction in which the third unit retreats from the first unit.

2. The medium-transporting device according to claim 1, wherein the supporting unit includes a first extension section that extends in one direction from the second rotational shaft and supports the outer roller and a second extension section that extends in another direction from the second rotational shaft and is configured to come into contact with the second unit, and in a state in which the second extension section receives a pressing force from the second unit, the second extension section is moved to the inner roller, and the first extension section is moved in a direction away from the inner roller.

3. The medium-transporting device according to claim 2, wherein the supporting unit includes an elastic member held by the first extension section and the third unit, and in a closed state in which the second unit forms the outer side of the inverting path, the elastic member applies an elastic force to the supporting unit such that the outer roller approaches the inner roller.

4. The medium-transporting device according to claim 1, wherein a plurality of supporting units are provided in an intersecting direction intersecting the transport direction.

5. The medium-transporting device according to claim 4, wherein a sheet member is provided in a portion of a path surface of the third unit, which forms the inverting path, and the sheet member extends to a portion downstream of the third unit in the transport direction from a portion located between the supporting units, which are adjacent to each other.

6. The medium-transporting device according to claim 4, wherein the plurality of supporting units include a first supporting unit that includes a first contact section and is located on a center side in the intersecting direction and a second supporting unit that includes a second contact section and is located outside the first supporting unit in the intersecting direction, the second unit includes a first contacting surface configured to come into contact with the first contact section and a second contacting surface configured to come into contact with the second contact section, and the first contacting surface is located downstream of the second contacting surface in a movement direction in which the second unit approaches the first supporting unit and the second supporting unit.

7. The medium-transporting device according to claim 1, wherein when the medium is transported on the inverting path, an upstream end of the supporting unit in the transport direction is located farther than a path surface of the third unit, which forms the inverting path, from the first unit.

8. The medium-transporting device according to claim 1, wherein when the medium is transported on the inverting path, a downstream end of the supporting unit in the transport direction is located closer than a path surface of the third unit, which forms the inverting path, to the first unit.

9. The medium-transporting device according to claim 1, further comprising a frame member that rotatably supports the first rotational shaft and a third rotational shaft, wherein the second unit is provided so as to be rotatable about the third rotational shaft.

10. The medium-transporting device according to claim 1, wherein the supporting unit includes a restricting section that restricts a rotational amount of the supporting unit when the supporting unit rotates in the direction in which the outer roller moves away from the inner roller.

11. The medium-transporting device according to claim 1, wherein an opening/closing unit that includes the first unit, the second unit, the third unit, and the supporting unit is coupled to a base unit, which supports the opening/closing unit, so as to be openable/closable, and when a state in which the opening/closing unit closes the base unit and in which the second unit forms the inverting path is a first setting state, a state in which the opening/closing unit closes the base unit and in which the second unit exposes the inverting path is a second setting state, and a state in which the opening/closing unit opens the base unit and in which the second unit exposes the inverting path is a third setting state, a space of the inverting path formed by the first unit and the third unit is provided such that a second space in the second setting state is wider than a first space in the first setting state and such that a third space in the third setting state is wider than the second space.

12. An image reading apparatus comprising:

a reading section that reads a surface of a medium that is transported; and the medium-transporting device according to claim 1 that transports the medium to the reading section.

* * * * *